US009480623B2

(12) United States Patent
Eilertsen et al.

(10) Patent No.: US 9,480,623 B2
(45) Date of Patent: Nov. 1, 2016

(54) PRE-ASSEMBLED FLUID TRANSFER ARRANGEMENT

(71) Applicant: Novo Nordisk Healthcare AG, Zurich (CH)

(72) Inventors: Lars Eilertsen, Fredensborg (DK); Klaus Bendix, Vanloese (DK); Matias Melander, Copenhagen (DK); Christian Hoejris Nielsen, Copenhagen NV (DK); Martin Rasmussen, Frederiksberg (DK); Jim Radmer, Fredensborg (DK); Jonas Hjortlund, Copenhagen S (DK); Soeren Dyring Jensen, Valby (DK)

(73) Assignee: Novo Nordisk Healthcare AG, Zurich (CH)

( * ) Notice: Subject to any disclaimer, the term of this patent is extended or adjusted under 35 U.S.C. 154(b) by 327 days.

(21) Appl. No.: 14/351,712

(22) PCT Filed: Oct. 15, 2012

(86) PCT No.: PCT/EP2012/070424

§ 371 (c)(1),
(2) Date: Apr. 14, 2014

(87) PCT Pub. No.: WO2013/053949

PCT Pub. Date: Apr. 18, 2013

(65) Prior Publication Data

US 2014/0311624 A1 Oct. 23, 2014

Related U.S. Application Data

(60) Provisional application No. 61/548,379, filed on Oct. 18, 2011, provisional application No. 61/548,925, filed on Oct. 19, 2011.

(30) Foreign Application Priority Data

Oct. 14, 2011 (EP) ..... 11185245
Oct. 14, 2011 (EP) ..... 11185248

(51) Int. Cl.
*A61J 1/20* (2006.01)

(52) U.S. Cl.
CPC ..... *A61J 1/2089* (2013.01); *A61J 1/2096* (2013.01); *A61J 1/201* (2015.05); *A61J 1/2013* (2015.05); *A61J 1/2051* (2015.05); *A61J 1/2065* (2015.05); *A61J 1/2075* (2015.05)

(58) Field of Classification Search
CPC ..... A61J 1/20; A61J 1/2003–1/2086
See application file for complete search history.

(56) References Cited

U.S. PATENT DOCUMENTS

| | | | |
|---|---|---|---|
| 3,397,694 | A | 8/1968 | Ogle |
| 3,993,063 | A | 11/1976 | Larrabee |

(Continued)

FOREIGN PATENT DOCUMENTS

| | | | |
|---|---|---|---|
| DE | 1913926 | | 9/1970 |
| EP | 335378 | A2 | 10/1989 |
| EP | 565103 | A1 | 10/1993 |
| EP | 592689 | A1 | 4/1994 |
| JP | H11-91789 | A | 4/1999 |
| WO | 9220388 | A1 | 11/1992 |
| WO | 9746203 | A1 | 12/1997 |
| WO | 2009/108847 | A1 | 9/2009 |
| WO | 2011/088471 | A1 | 7/2011 |
| WO | 2011112136 | A1 | 9/2011 |

*Primary Examiner* — Tatyana Zalukaeva
*Assistant Examiner* — Benjamin Klein
(74) *Attorney, Agent, or Firm* — Jianjie Hu

(57) ABSTRACT

The present invention relates to a medical device (1, 100) comprising a first container (10, 110) holding a first medium and defining a general axis, a second container (20, 120) holding a second medium, and fluid connection means (50, 150) for establishing fluid connection between the first container (10, 110) and the second container (20, 120), the fluid connection means (50, 150) being arranged at least partially between the first container (10, 110) and the second container (20, 120). The device further comprises a cover receiving portion (42, 42) and a cover (4, 104) removably mounted thereon to shield at least an operable portion of the first container (10, 110). The cover (4, 104) is operatively coupled with the fluid connection means (50, 150) and configured to cause a relative converging motion between at least one of the first container (10, 110) and the fluid connection means (50, 150) and the second container (20, 120) and the fluid connection means (50, 150) in response to a dismounting of the cover (4, 104) from the cover receiving portion (42, 142).

25 Claims, 15 Drawing Sheets

(56) References Cited

U.S. PATENT DOCUMENTS

| | | | | |
|---|---|---|---|---|
| 4,338,980 | A | 7/1982 | Schwebel et al. | |
| 4,465,183 | A | 8/1984 | Saito et al. | |
| 5,041,088 | A | 8/1991 | Ritson et al. | |
| 5,342,346 | A * | 8/1994 | Honda | A61J 1/2089 604/411 |
| 5,466,220 | A | 11/1995 | Brenneman | |
| 5,782,345 | A | 7/1998 | Guasch et al. | |
| 5,827,262 | A | 10/1998 | Neftel et al. | |
| 6,135,275 | A | 10/2000 | Kelders et al. | |
| 6,258,078 | B1 * | 7/2001 | Thilly | A61J 1/2096 206/363 |
| 7,077,835 | B2 | 7/2006 | Robinson et al. | |
| 2010/0241088 | A1 | 9/2010 | Ranalletta et al. | |

* cited by examiner

PRE-ASSEMBLED FLUID TRANSFER ARRANGEMENT

CROSS-REFERENCE TO RELATED APPLICATIONS

This application is a 35 U.S.C. §371 National Stage application of International Application PCT/EP2012/070424 (published as WO 2013/053949), filed Oct. 15, 2012, which claimed priority of European Patent Application 11185248.9, filed Oct. 14, 2011, and claimed priority of European Patent Application 11185245.5, filed Oct. 14, 2011; this application claims priority under 35 U.S.C. §119 of U.S. Provisional Application 61/548,379; filed Oct. 18, 2011, and claims priority under 35 U.S.C. §119 of U.S. Provisional Application 61/548,925; filed Oct. 19, 2011.

FIELD OF THE INVENTION

The present invention relates generally to medical devices and more specifically to devices for transferring one or more substances between separate containers.

BACKGROUND OF THE INVENTION

Within drug delivery it may be of vital importance to maintain purity of a product to be administered from its production to its administration. Many drug substances are therefore supplied in sealed containers having penetrable access means, such as rubber septa, which are adapted to be pierced by a suitable tool, e.g. a hollow needle.

For example, people with IDDM frequently attach an injection needle to their insulin pen to thereby penetrate a self-sealing rubber septum of an insulin containing cartridge and establish a delivery line for subcutaneous administration. The needle and the insulin are stored in respective sterile environments until the point of connection.

Some pharmaceutical drugs adapted for parenteral administration are only stable in the administrable form a relatively short period of time. For convenience reasons, and in order to extend the shelf life of such a drug, it is sometimes preferred to store individual constituents of the drug separately and to mix them only just before a dose is needed.

Traditionally, a mixing of two substances stored in separate vials is performed using a syringe with a needle to withdraw the substance from the one vial and inject it into the other vial. The syringe with the attached needle is then used to withdraw from this vial the desired amount of drug to be injected into the patient. Oftentimes, the needle used for transferring the substances must be replaced by another needle for the actual administration of the drug.

This kind of manual operation may be cumbersome and may bring about some uncertainty as to the exact concentration of the resulting drug, because it can be difficult to completely empty a vial by such an approach. Moreover, since the first substance is withdrawn from one vial and transported to another vial via a syringe with a needle, typically including a penetration of two rubber septa in order to establish fluid connection to the respective vial interiors, both sterility and safety (in terms of e.g. risk of needle stick injuries) may be compromised. To reduce the risk of contamination of the administrable substance it is customary to clean the respective rubber septa with an alcohol swab before needle penetration. This, however, is often considered a hassle by the user, especially if she/he needs to mix the substances and administer the resulting drug quickly to avert a serious situation.

U.S. Pat. No. 5,466,220 (Bioject, Inc.) discloses different examples of drug vial mixing and transfer devices comprising one or two vials and a syringe pre-aligned and packaged in sealed sterile packages to eliminate the need for swabbing the vials before piercing and to avoid sharp needle exposures. While overcoming some of the drawbacks of the traditional way of mixing substances, the solutions comprising two vials appear bulky and operationally cumbersome, and the solutions including a single vial introduce a risk of carrying out the individual operational steps in a wrong order, because the syringe plunger is operable before connection of the vial and the syringe, thereby enabling unintended delivery of some of the syringe contents to the exterior of the vial.

WO 97/46203 (Applied Research Systems ARS Holding N.V.) discloses a pre-assembled pack for a drug reconstituting device, which pack comprises a vial co-axially aligned with a cartridge and separated therefrom by a double-ended needle element. In the pre-use state of the device the needle element is shielded at each end by a slidable bung, providing for closed, sterile needle chambers. Like the above mentioned prior art solutions including a single vial, this pack also lacks a mechanism which prevents it from being manipulated erroneously to e.g. expel the contents of the cartridge before fluid connection to the vial has been established.

EP 0 565 103 A1 (Nissho Corporation) discloses a bedside mixing arrangement comprising a drug vial, a solvent bag, a double-pointed hollow needle, and a guide capsule with a cap rotatably mounted thereon. The cap serves as a means for driving the drug vial towards the solvent bag for establishment of fluid connection between the two via the double-pointed hollow needle. To mix the drug and the solvent, firstly the cap is operated to cause the fluid connection to be established, then the entire arrangement is turned upside down allowing the solvent to flow into the drug vial to mix with the drug, and finally the entire arrangement is turned upside down again to transfer the drug solution to the solvent bag. This mixing procedure is slow and cumbersome given the size and flexibility of the solvent bag. Furthermore, the dimensions of this arrangement make it ill-suited for being carried about in connection with regular ambulatory use.

WO 2011/088471 (Bayer Healthcare LLC) discloses a device comprising a receptacle, a spike assembly having a perforating shaft and a connector element for receiving a syringe, and an actuating mechanism for automatically causing the shaft to perforate a closure of the receptacle upon rotation of an outer cover surrounding the spike assembly. While this device ensures that fluid communication between the spike assembly and the receptacle is established before a syringe is even capable of being attached to the spike assembly, it does not overcome the problems of potential premature activation of the syringe piston. Moreover, in principle the connector element needs to be swabbed before attachment of the syringe to secure a reasonable level of cleanliness during the mixing procedure. This requires additional operational steps to be performed by the user, prolonging the time needed to prepare a drug product for administration.

Especially for people who must administer a therapeutic agent several times during the day it is of importance that a portable delivery device is compact such that it takes up as little space as possible in e.g. a bag or a pocket. If the delivery device is a syringe type device comprising a piston which is slidable in a tubular reservoir in response to an operation of a piston rod, and if the device is prefilled with the therapeutic agent, or with a component therefore such as a solvent or a diluent, the axial dimension of the device must be at least twice the axial dimension of the reservoir in order to enable complete emptying thereof, because the piston rod has to extend beyond the reservoir a distance corresponding to the full stroke of the piston in the pre-use state of the device.

WO 2009/108847 (Becton, Dickinson and Company) discloses a prefilled syringe with a two piece piston rod comprising a first piece slidably mounted to a second piece, allowing the piston rod to be extended from a compressed length to an extended length by application of an axial force in the proximal direction.

While such a solution may reduce the overall dimension of the syringe in the storage condition, it adds to the number of operational steps a user must perform in order to prepare the syringe for administration of its contents. Whereas an ordinary prefilled syringe may be operated to expel its contents immediately upon removal from its packaging the preparation steps for the syringe disclosed in WO 2009/108847 include 1) removing the syringe from the packaging, 2) applying an initial axial force to one of the piston rod pieces in the proximal direction to cause disengagement of the locking elements interlocking the two piston rod pieces, and 3) applying a continuous axial force to the piston rod in the proximal direction so a locking element of the first piston rod piece engages with a locking element of the second piston rod piece.

It is therefore desirable to provide a solution of the type disclosed in WO 2009/108847 which does not entail any additional operational steps for a user.

SUMMARY OF THE INVENTION

In view of the above, it is an object of the invention to provide an arrangement for securing safe and clean (e.g. sterile) fluid access to a medical container. Further, it is an object of the invention to provide an arrangement for safe and clean (e.g. sterile) transfer of media between containers. In particular, it is an object of the invention to provide a simple, intuitive and easy to use handheld arrangement for mixing substances contained in separate containers, which arrangement reduces or eliminates the risk of erroneous handling and ensures that purity (e.g. sterility) of the substances is maintained throughout the mixing procedure.

It is a further object of the invention to provide a handheld medical device for mixing substances that requires a minimum number of operational steps and optionally includes an integrated automatic sequence controller, ensuring correct establishment of fluid connection between the individual elements.

It is an even further object of the invention to provide a handheld medical device for transferring media between separate containers, where the configuration of the device ensures that a user cannot accidentally operate, e.g. pressurise, any of the containers until a fluid connection between the containers has been properly established.

It is an even further object of the invention to provide a medical mixing device which is easily transportable and which fits into e.g. a small handbag, thereby increasing opportunities for a flexible lifestyle.

In the disclosure of the present invention, aspects and embodiments will be described which will address one or more of the above objects and/or which will address objects apparent from the below disclosure as well as from the description of exemplary embodiments.

In an aspect of the invention a medical arrangement, in particular a handheld medical device, is provided comprising a first container comprising a variable volume chamber holding a first medium, a second container holding a second medium, fluid connection means (e.g. a fluid connection structure) for establishing a fluid connection between the first container and the second container, a cover receiving portion, and a cover removably mounted on the cover receiving portion to shield at least an operable portion of the first container. The cover is operatively coupled with the fluid connection means and configured to cause a relative converging motion between at least one of a) the first container and the fluid connection means and b) the second container and the fluid connection means in response to a dismounting of the cover from the cover receiving portion.

In another aspect of the invention, a medical device is provided comprising a first container comprising a variable volume chamber holding a first medium, a second container holding a second medium, fluid connection means (e.g. a fluid connection structure) for establishing a fluid connection between the first container and the second container, a cover receiving portion, a cover removably mounted on the cover receiving portion to shield at least an operable portion of the first container, the cover being operatively coupled with the first container so that a displacement of the cover in a first axial direction relative to the cover receiving portion activates the first container, and guide means structured to displace an activated first container in a second direction, the second direction being opposite to the first direction and towards the fluid connection means.

In a further aspect of the invention a medical device is provided comprising a first container holding a first medium and defining a general axis, a second container holding a second medium, and fluid connection means (e.g. a fluid connection structure) for establishing fluid connection between the first container and the second container, the fluid connection means being arranged at least partially between the first container and the second container. The device further comprises a cover receiving portion and a cover removably mounted thereon to shield at least an operable portion of the first container. Guide means are also provided for guiding a relative motion between the first container and the second container from a first relative position in which the first container and the second container are fluidly unconnected and spaced apart a first axial distance to a second relative position in which the first container and the second container are spaced apart a second axial distance, which is smaller than the first axial distance. The cover is operatively coupled with the first container, the operative coupling being configured to cause a relative motion between the first container and the second container from the first relative position to the second relative position in response to a dismounting of the cover from the cover receiving portion.

The relative motion between the first container or the second container and the fluid connection means may be caused by a dismounting of the whole cover or of only a portion of the cover from the cover receiving portion.

The cover receiving portion may be arranged to at least partially encircle at least a portion of at least one of the first container, the second container, and the fluid connection means.

An arrangement or device as defined by any of the above aspects of the invention makes it possible to ensure both safety and a high level of purity throughout the mixing procedure because the user is not in risk of accidental needle sticks, as any sharp objects may be arranged unexposed, and because selected parts of the arrangement may be sterilised before assembly and made inaccessible to the user during use. Furthermore, since the cover shields at least an operable portion of the first container, e.g. the entire first container, the arrangement enables a construction by which the user cannot accidentally activate this container prematurely to thereby lose some of its contents to the surroundings.

In particular embodiments the fluid connection means establishes fluid communication between the interior of the first container and the interior of the second container in response to the dismounting of the cover from the cover receiving portion. Thereby, it is ensured that fluid communication between the two containers is properly established before the user gains access to operate any volume altering means of the arrangement, excluding any potential erroneous operation of the device in relation thereto. Since the cover must be removed from the cover receiving portion anyway to enable operation of the device, it is both convenient and time saving to provide for a simultaneous automatic execution of another mandatory action.

In the present context "a dismounting of the cover from the cover receiving portion" means a relative motion between the cover and the cover receiving portion eventually leading to a disengagement of or a termination of interaction between the two. It is noted that the actual disengagement or termination of interaction may occur simultaneously with or subsequent to the particular effect which the relative motion between the cover and the cover receiving portion induces.

Further, in the present context "an operable portion of the first container" should be understood as a portion of the first container which can be operated by the user to perform an action which has an effect on the contents thereof, e.g. a portion of an actuator for a displaceable wall which can be moved relative to the remaining portion of the first container to selectively decrease and increase its internal volume. A specific example hereof is a piston rod adapted to move a piston in a syringe barrel.

The second container may be co-axially aligned with the first container and the fluid connection means, whereby a slender configuration of the device is enabled. This is preferred by some users, as a slender device may more easily fit into e.g. a pocket or a small handbag. A longitudinal axis of the first container may define the axis of alignment. In particular, the fluid connection means may be arranged axially between the first container and the second container. In such an arrangement a relative converging motion between at least one of the first container and the fluid connection means and the second container and the fluid connection means necessarily entails a relative converging motion between the first container and the second container.

Following establishment of fluid communication between the first container and the second container, the first medium may be transferred to the second container via the fluid connection means to mix with the second medium to produce a resulting drug product, and the drug product may subsequently be transferred the opposite way to the first container via the fluid connection means.

The cover may form part of an enclosure for the first container, the second container, and the fluid connection means. Thereby, a controlled environment for these components may be established to reduce or eliminate the risk of impurities being introduced into the resulting drug product.

In particular embodiments the cover is a rigid cap adapted to form part of an at least partly rigid enclosure for the first container, the second container, and the fluid connection means. Such an enclosure further allows a user to bring the device about in e.g. a pocket or a handbag without having to fear that an interaction with other contents thereof might cause an unintended activation of the first container.

The volume of the variable volume chamber may be varied by operation of an actuator, and the cover may be adapted to shield at least an operable portion of the actuator when mounted on the cover receiving portion.

The fluid connection means may comprise a base section arranged, e.g. extending transversally, between the first container and the second container, a first hollow penetration member protruding axially from a first face of the base section in the direction of the first container, and a second hollow penetration member protruding axially from a second face of the base section in the direction of the second container. The first penetration member may comprise first piercing means, such as a pointed end, adapted to penetrate a closure of the first container. Similarly, the second penetration member may comprise second piercing means adapted to penetrate a closure of the second container. The interiors of the respective first and second hollow penetration members may be fluidly connected at the base section. In some embodiments, the respective first and second hollow penetration members are co-axially aligned at each side of the base section. Such a configuration may be especially suitable for use in a device where the two containers are also co-axially aligned.

The first penetration member may initially be encapsulated by a first penetrable sheath element, and the second penetration member may initially be encapsulated by a second penetrable sheath element, each sheath element being capable of maintaining an internal environment for the respective penetration member, which is characterised by a specific airborne particulate cleanliness. Thereby, the fluid connection means may e.g. be sterilised and the penetration members may be covered by the respective sheath elements in an aseptic cleanroom area before assembly of the medical device, securing a high level of cleanliness for the flow route. During use of the medical device, in connection with the establishment of fluid communication between the first container and the second container, the first sheath element is then penetrated by the first penetration member prior to the first container closure, and, likewise, the second sheath element is then penetrated by the second penetration member prior to the second container closure.

The cover and the cover receiving portion may be adapted for threaded engagement via a first track section having a first pitch, and the dismounting of the cover from the cover receiving portion may cause a relative helical motion between the first container and the cover or the cover receiving portion, which is defined by a second track section having a second pitch.

The second pitch may be greater than the first pitch to reduce the relative angular displacement between the cover and the cover receiving portion required to cause fluid connection to be established between the first container and the second container, thereby increasing the user convenience of the device.

In particular embodiments the pitch difference is adapted to cause an establishment of fluid communication between the first container and the second container upon less than one full revolution of the cover relative to the cover receiving member.

The cover receiving portion may be arranged on a coupling element, and the second container may be locked against at least distal motion relative to the coupling element. For example, the coupling element may comprise reception means, such as e.g. a clamp structure, for receiving and retaining the second container. Thereby, a converging relative motion between the first container and the second container is easily controllable, as it involves only a unidirectional motion of the first container towards a stationary second container.

As used herein in relation to the above aspects of the invention, the term "distal" refers to a portion, position or direction opposite or away from the operable portion of the first container, whereas "proximal", conversely, refers to a portion, position or direction close to or towards the operable portion of the first container.

The medical device may further comprise a first container support element adapted to, e.g. releasably, hold and/or support the first container, and a guide interface structured to provide for a guided relative motion between the first container support element and the second container during the dismounting of the cover (4) from the cover receiving portion (40). The cover may be structured to interact with the first container support element to activate the first container support element in response to a dismounting motion of the cover relative to the cover receiving portion, and the guide interface may be structured to displace an activated first container support element towards the second container.

The guide means, or the guide interface, guiding the relative motion between the first container and the second container may comprise cooperating threaded sections providing for a helical motion of the first container relative to the coupling element. Alternatively, the guide means, or the guide interface, may be structured to provide for a translational relative motion between the first container and the coupling element. Further, alternatively or additionally, the guide means may comprise cooperating threaded sections providing for guided motion of the second container relative to the coupling element.

The cooperating threaded sections may be provided as a first thread on the coupling element and a mating first container support thread on the first container support element. The coupling element may further comprise a second thread adapted for engagement with a cover thread on the cover for mounting, respectively dismounting, of the cover on/from the coupling element. The first thread and the second thread may be opposite in the sense that the first thread may be a left-hand thread and the second thread a right-hand thread, or vice versa. Further, the first thread may be an internal thread in the coupling element, while the second thread may be an external thread on the coupling element. The first thread thereby cooperates with an external thread on the first container support element and the second thread cooperates with an internal thread in the cover.

The cover may be operatively coupled with the first container via cover engagement means on or in the cover interacting with container engagement means associated with the first container. In the present context, the term "associated with the first container" should be understood as either "arranged on the first container" or "arranged on a separate element connected to the first container".

For example, the cover may be operatively coupled with the first container via the first container support element. The cover engagement means may be structured for engagement with container engagement means on the first container support element to ensure joint rotational motion of the cover and the first container support element when the cover performs a rotational motion in a dismounting direction relative to the cover receiving portion. In that case, a unidirectional rotational lock between the first container and the first container support element may be incorporated to ensure joint rotational motion of the first container and the first container support element when the first container support element and the cover rotate jointly.

Alternatively, the cover may be coupled directly to the first container through interacting cover engagement means and container engagement means provided on the first container.

The cover engagement means may comprise longitudinally extending ribs on interior surface portions of the cover, and the container engagement means may comprise pawls configured for engagement with the respective ribs, each pawl being capable of sliding axially along a rib. In particular, the operative coupling between the cover and the first container may comprise a ratchet adapted to allow rotation of the cover in one direction relative to the first container and to prevent rotation of the cover in the opposite direction relative to the first container. Alternatively, the cover engagement means may comprise a curved, e.g. helical, groove and the container engagement means may comprise a cam adapted to slide in the groove in response to a relative axial motion between the cover and the cover receiving portion.

The combination of the rotational coupling between the cover and the first container and the opposite first and second threads provide for an arrangement wherein a rotation of the cover relative to the cover receiving portion results in an axial opposite displacement of the cover and the first container relative to the coupling element. Thereby, while the cover is gradually unscrewed from the second thread the first container is lead towards the second container, e.g. carried by the first container support element, along the first thread.

The pitch of the first thread may be greater than the pitch of the second thread, whereby the axial movement of the first container relative to the coupling element is longer than the axial movement of the cover relative to the coupling element upon a given angular displacement of the cover along the second thread, giving a result corresponding to what is described in the above in connection with the first and second track sections The guide means may be configured to lead the first container support thread to the end of the first thread during establishment of fluid communication between the first container and the second container. The fluid connection means may be mounted in a hollow portion of the first container support element by e.g. a friction fit, in which case when the first container support thread travels the first thread the first container is moved towards the fluid connection means which is again moved towards the second container. In case the operative coupling between the cover and the first container prevents relative rotational motion between the two during dismounting of the cover from the cover receiving portion but allows relative rotational motion between them during mounting of the cover onto the cover receiving portion, an arrangement is provided in which the cover is irremovably re-mountable on the cover receiving portion. This is due to the fact that when the first container support thread is at the end of the first thread, the first container support element is not capable of rotating any further with respect to the coupling element. Hence, once the cover is re-mounted on the second thread it cannot be released from it because the cover is locked against rotation relative to the first container support element.

Alternatively, the cover engagement means may comprise a helical track on or in an interior surface portion of the cover, the container engagement means may comprise a track follower on the first container support element, and the first container support element may be rotationally locked with respect to the coupling element, e.g. splined thereto, such that a relative rotational motion between the cover and the cover receiving portion along the first track section causes a non-rotational relative motion between the first container support element and the coupling element, leading the first container non-rotationally towards the second container.

The fluid connection means may be carried by the first container support element before and during the relative motion between the first container and the second container. In particular, the first container support element may comprise first positioning means interacting with the first face of the base section and second positioning means interacting with the second face of the base section to translationally fix the fluid connection means relative to the first container at a position in which the first penetration member is spaced apart from the first container closure, and the first positioning means may be configured to automatically abort the interaction with the first face upon penetration of the second container closure by the second penetration member, thereby enabling relative translational motion between the fluid connection means and the first container.

Such a construction will provide for a complete control of the position of the fluid connection means before and during establishment of fluid communication between the first container and the second container. Not only is the fluid connection means stably arranged relative to the two containers, the order of penetration of the respective container closures is predetermined. During the first part of the operation the fluid connection means moves translationally towards the second container along with the first container support element, due to the interaction between the first positioning means and the first face, until the second container closure is penetrated by the second penetration member. Thereafter, due to the first positioning means ceasing to interact with the first face, the further translational movement of the first container support element towards the second container causes a relative translational motion between the first container and the fluid connection means until the first container closure is penetrated by the first penetration member.

A penetration sequence control of this type may be incorporated to ensure that fluid access to the second container is obtained before the first container closure is penetrated. In some cases, a reverse penetration sequence could cause an undesired application of a portion of the first medium to the exterior of the second container, giving rise to uncertainty as regards to the actual volumetric ratio of the media being mixed, and thereby to the potency of the final drug product.

In particular embodiments the first positioning means comprises a plurality of radially deflectable legs extending axially from a circumferential base of the first container support element, each leg comprising an inwardly extending abutment surface for abutment with a portion of the first face, and the coupling element comprises a plurality of sloping guide surfaces configured to guide the plurality of radially deflectable legs radially outwards upon penetration of the second container closure by the second penetration member during the relative motion between the first container support element and the second container, whereby the abutment surfaces are brought out of contact with the first face.

The coupling element may further comprise locking means for interacting with the first container support element to translationally fix the first container support element with respect to the second container upon the subsequent penetration of the first container closure by the first penetration member. Thereby, it is ensured that the first container and the second container remain fluidly connected during the entire process of transferring the first medium to the second container and the mixture from the second container to the first container.

In some embodiments, each of the plurality of radially deflectable legs further comprises a catch portion, and the coupling element further comprises a plurality of ramp portions, each ramp portion being structured to deflect one of the radially deflectable legs radially outwards during the relative motion between the first container support element and the second container and to allow the radially deflectable leg to elastically recover beyond a ramp edge such that the catch portion snap fits to a distal side of the ramp portion.

In particular embodiments, the first container is a syringe type applicator comprising a cylindrical barrel and a piston defining a syringe compartment for holding the first medium. The piston is capable of sliding motion with respect to the barrel by operation of a piston rod to selectively decrease and increase the volume of the syringe compartment. Thereby, the first medium can be easily transferred from the first container to the second container through the fluid connection means and easily transferred back to the first container, e.g. as a component of a mixture in case the second container initially contains a miscible medium.

The syringe type applicator may be removably mounted in the first container support element, whereby after effectuating the above described fluid transfer, the syringe type applicator may be removed from the first container support element and used as an administration device.

In particular embodiments, the syringe type applicator comprises a Luer outlet and a penetrable syringe stopper adapted to seal the outlet before use of the medical device. The Luer outlet then enables attachment of selective suitable delivery means, such as e.g. an infusion set, for percutaneous access to a subject user.

The medical device may be structured to retain the syringe stopper during removal of the syringe type applicator from the first container support element. The unidirectional rotational lock between the first container and the first container support element may thus comprise a threaded Luer collar on the syringe type applicator and a mating thread on a syringe stopper retaining member which is translationally locked to the syringe stopper and rotationally as well as unidirectionally translationally locked with respect to the first container support element. Thereby, when the syringe type applicator is released from the first container support element by unscrewing of the Luer collar from the thread on the syringe stopper retaining member, the syringe stopper is prevented from moving relative to the first container support element, and the Luer outlet is automatically exposed to the surroundings, eliminating an additional manual syringe stopper removal step.

The syringe type applicator may further be adapted for re-mounting in the first container support element. Thereby, the user will not have to worry about where to place the administration device after use. In case the cover is irremovably re-mountable on the cover receiving portion, as described in the above, the cover may even be used to collect the disposables, such as e.g. the infusion set, after administration and to provide for a closed storage space for the used syringe type applicator and the disposables through re-mounting on the cover receiving portion. Since the piston rod has advanced the piston to the distal most position in the barrel during emptying of the syringe type applicator the axial dimension of the syringe type applicator is significantly reduced compared to its initial axial dimension. This leaves sufficient room for the disposables in the established storage space between the end portion of the piston rod and the cover. Hence, the medical device can e.g. be used as a safe and inaccessible sharps container after transfer and delivery of the contents of the two containers.

The medical device may further comprise a base element surrounding at least a portion of the coupling element. The base element and the coupling element may be structured to enable a limited relative rotation of the two, e.g. guided by a bayonet groove in the coupling element adapted for slidable reception of a cam on the base element. The second container may be supported by a second container support element arranged non-rotatably relative to the base element, e.g. via an axial groove on one entity and a mating axial track on the other, or via other suitable mechanical engagement structures. The second container support element may comprise a second container support thread adapted for mating engagement with a third thread on the coupling element.

The third thread may be arranged distally of the first and second threads and may be structured to cause the second container support element to perform an axial displacement towards the fluid connection means in response to a rotation of the coupling element relative to the base element. Thereby, by causing a relative rotational motion between the base element and the coupling element the second container can be forced against the fluid connection means to provide a firmer mechanical attachment thereto, increasing the robustness of the arrangement.

A relative rotational motion between the base element and the coupling element may be performed automatically during the unscrewing of the cover from the second thread on the coupling element when the first container support thread travels the first thread, depending on the present frictional relationships between the individual materials and structures.

Alternatively, or additionally, a relative rotational motion between the base element and the coupling element may be performed automatically during the unscrewing of the cover from the second thread on the coupling element subsequent to the first container support thread having travelled to the end of the first thread. This may be obtained by ensuring that the distance the cover thread has to travel along the second thread to release the cover from the coupling element is longer than the distance the first container support thread has to travel along the first thread to reach the end of the first thread. Hence, if the second thread is longer than the first thread, the first container support thread reaches the end of the first thread, and fluid connection is established between the first container and the second container, during dismounting of the cover from the cover receiving portion, while the cover thread is at an intermediate position relative to the second thread in which the cover is still not released from the coupling element. Whether or not the coupling element and the base element have undergone a relative rotation during the travel of the cover thread to the intermediate position, once the first container support thread is at the end of the first thread a further application of a torque to the first container support element, e.g. from the further rotation of the cover, may cause a joint rotation of the first container support element and the coupling element relative to the base element. Thereby, an arrangement is provided wherein the tightening of the second container to the fluid connection means is automatically executed during a final dismounting rotation of the cover.

Alternatively, a relative rotational motion between the base element and the coupling element may be performed manually, e.g. by turning an exposed portion of the coupling element about the general axis while clutching the base element.

The second container support element may comprise an at least partly enclosing frame adapted to accommodate the second container. In some embodiments, the second container support element comprises a cylindrical case which together with the base element encapsulates the second container to render the second container inaccessible to subject users. The cylindrical case is provided with an internal thread which mates with the third thread on the coupling element.

It is noted that whereas the third thread has been described in the foregoing as forming part of the coupling element, the third thread may alternatively be provided on a separate element which is rotatably locked with respect to the coupling element.

The second container support element may further comprise bias means structured to exert a biasing force on the second container for biasing the second container towards the first container. In particular embodiments, the bias means comprises one of more spring members arranged in a bottom portion of the second container support element.

During assembly of the medical device it may be important to secure a specific position of the first container support element relative to the coupling element, e.g. to ensure a correct placement of the fluid connection means to avoid premature penetration of the container closures. This may be accomplished through a marker that defines a particular relative position of the first container support thread and the first thread on the coupling element. Such a marker may comprise a first catch geometry associated with the first container support thread and a mating second catch geometry associated with the first thread.

In some embodiments, the first catch geometry comprises a notch structure in the first container support thread and the second catch geometry comprises a deflectable finger structure at the start of the first thread which is adapted to ride along the first container support thread in a deflected state, during an initial joining of first container support element and the coupling element, until it reaches the notch structure. At this point, the deflectable finger structure becomes unloaded and enters into a mating engagement with the notch structure to prevent the first container support thread from being moved reversely along the first thread beyond the notch structure. However, importantly, the engagement is of the type which allows further joining of the first container support element and the coupling element. When the deflectable finger structure enters into the notch structure it emits a click sound to provide an audible alert that the desired relative position of the first container support element and the coupling element has been reached.

In a particular embodiment of the invention a medical device is provided comprising a syringe holding a first medium, the syringe having a tip portion defining a syringe outlet, and a Luer connector arranged at the tip portion, a syringe tip cap for sealing the syringe outlet, a tip cap retainer structured to non-releasably hold the syringe tip cap, the tip cap retainer comprising a coupling portion adapted for releasable connection with the Luer connector, a vial holding a second medium, the vial being axially aligned with the syringe and having a neck portion defining a vial outlet, and a vial stopper for sealing the vial outlet, a cylindrical coupling element comprising a vial retaining portion adapted to receive and hold the vial, and a cap receiving portion comprising a first helical track, a cap releasably mounted on the cap receiving portion to cover at least a portion of the syringe, the cap comprising a second helical track, and a first track follower adapted for mating engagement with the first helical track, a fluid connection unit arranged axially between the syringe and the vial and comprising a transversal base, a first pointed structure extending in a first direction from the transversal base for penetrating the syringe tip cap, and a second pointed structure extending in a second direction from the transversal base for penetrating the vial stopper, and a syringe holder rotationally locked with respect to the coupling element and structured to rotationally and translationally retain the tip cap retainer, the syringe holder comprising a second track follower adapted for mating engagement with second helical track such that a rotation of the cap relative to the cap receiving portion causes a translational movement of the syringe holder towards the vial, the syringe holder further comprising support means for stable positioning of the fluid connection unit in a position in which the first pointed structure is spaced apart from the syringe tip cap, the support means comprising a proximally oriented support surface adapted to abut a distally oriented surface of the transversal base, and a distally oriented support surface adapted to abut a proximally oriented surface of the transversal base, wherein the distally oriented support surface is adapted to be moved out of abutment with the transversal base in response to the syringe holder reaching a position relative to the vial in which the second pointed structure has penetrated the vial stopper. A vial casing adapted to cover at least a portion of the vial is optionally included. If so, the vial casing is rotationally and translationally fixed with respect to the coupling element.

An important factor for the outcome of certain disease related events, such as e.g. spontaneous bleeding episodes for a person with haemophilia, is the so-called time-to-treatment. In order to reduce the time-to-treatment, e.g. for people with bleeding disorders, devices offering a high degree of portability are desirable, because such devices are more likely to be carried about during the day, thereby generally increasing availability at a sudden onset of bleeding. One aspect of portability is the physical size of the device. For a syringe type device which includes an elongated drug reservoir and a piston rod for activation of a piston, a telescopic piston rod system may be employed to reduce the axial dimension of the device. However, a telescopic piston rod mechanism can be fiddly to handle for a person in a stressful situation, and this may lead to a less than optimal treatment.

In a further aspect of the invention a medical device is provided comprising: a container defining a variable volume chamber adapted to hold a fluid medium, an actuation element for varying the volume of the chamber, a cover receiving portion, and a cover removably mounted on the cover receiving portion to shield at least an operable portion of the actuation element, wherein the actuation element is extendable from a first axial dimension to a second axial dimension, and wherein the cover is coupled with the actuation element and configured to extend the actuation element from the first axial dimension to the second axial dimension in response to the cover undergoing relative motion with respect to the cover receiving portion.

In particular, the actuation element may be extended from the first axial dimension to the second axial dimension in response to the cover being dismounted from the cover receiving portion.

The above solution enables an automatic actuator extension e.g. by removal of a cover, such as a packaging or a portion of a packaging. Specifically, the medical device may comprise a syringe comprising a syringe barrel holding a volume of a substance, which syringe barrel is closed at one end by a movable piston, and a piston rod operatively coupled with the piston and adapted to move the piston in the syringe barrel to expel at least a portion of the substance therefrom through a syringe outlet, and the removable cover may be adapted to cover a user operable portion of the piston rod in a pre-use state of the device.

In terms of the syringe the present solution enables an automatic extension of the piston rod from an initial storage state to an extended state in response to a relative motion between the syringe and the syringe cover, e.g. during removal of the syringe cover from the syringe. In case the syringe cover is adapted to cover an operable portion of the piston rod to thereby prevent the piston rod from premature operation a removal of the syringe cover is necessary before the substance can be administered. In other words, the present solution utilises an already included step to execute an additional step automatically, thereby avoiding further user operation and, additionally, ensuring correct extension of the piston rod.

Notably, the actuation element may be extendable from the first axial dimension to the second axial dimension while the volume of the variable volume chamber is maintained constant, thereby preventing a premature pressure variation in the variable volume chamber.

The volume of the variable volume chamber may be varied by actuation of a movable wall, and the actuation element may comprise a first actuation element portion and a second actuation element portion capable of undergoing relative axial displacement from a first relative axial position defining the first axial dimension of the actuation element to a second relative axial position defining the second axial dimension of the actuation element. The first actuation element portion may be coupled with the movable wall, and the second actuation element portion may be coupled with the cover so that an axial displacement of the cover in a proximal direction relative to the cover receiving portion causes a displacement of the second actuation element portion in the proximal direction relative to the first actuation element portion.

In case of the syringe the piston rod may comprise a hollow cylindrical first piston rod portion and a hollow cylindrical second piston rod portion arranged concentrically with the first piston rod portion to provide a telescopic construction by which the second piston rod portion is slidable relative to the first piston rod portion to increase the overall length of the piston rod. The second piston rod portion may be arranged at least partially within the first piston rod portion. Alternatively, the first piston rod portion may be arranged at least partially within the second piston rod portion.

The static friction between the first piston rod portion and the second piston rod portion may be lower than the static friction between the piston and the syringe barrel. This will ensure that the piston remains stationary in the syringe barrel while the second piston rod portion is slid along the first piston rod portion during the relative motion between the cover and the cover receiving portion.

In particular embodiments the first actuation element portion and the second actuation element portion are adapted to interlock in response to the actuation element being extended to the second axial dimension to thereby provide a rigid construction which may be manipulated by the user to advance the movable wall in a controlled manner. For example, one of the first piston rod portion and the second piston rod portion may comprise a reception geometry, and the other of the first piston rod portion and the second piston rod portion may comprise a flexible catch geometry adapted to engage with the reception geometry when the actuation element is extended to the second axial dimension, where the flexible catch geometry is biased towards the one of the first piston rod portion and the second piston rod portion during extension of the actuation element from the first axial dimension to the second axial dimension.

The cover may comprise first engagement means and the second actuation element portion may comprise second engagement means releasably engaged with the first engagement means. Further, the first engagement means and the second engagement means may be configured to automatically disengage upon extension of the actuation element from the first axial dimension to the second axial dimension. In that connection, it is noted that the actual disconnection of the cover from the second actuation element portion may require an axial movement of the cover relative to the second actuation element portion subsequent to the interlocking of the first actuation element portion and the second actuation element portion.

An automatic disengagement of the first engagement means and the second engagement means will allow the cover to be completely removed from the rest of the medical device without the user having to engage in an additional handling step. For people with impeded dexterity this may reduce the time required to prepare the device for drug administration significantly.

Specifically, one of the first engagement means and the second engagement means may comprise a protrusion and the other of the first engagement means and the second engagement means may comprise a flexible catch structure adapted to receive and hold the protrusion.

In some embodiments the protrusion comprises a radially enlarged section, and the flexible catch structure comprises a plurality of radially deflectable arms which are adapted to engage with the radially enlarged section to initially limit or prevent motion of the cover relative to the second actuation element portion in at least the proximal direction and further to deflect radially to thereby disengage from the radially enlarged section upon extension of the actuation element to the second axial dimension and in response to further proximal force application by the protrusion.

The medical device may further comprise a container support element, with respect to which the container is translationally fixed, and guide means. The cover may be operatively coupled with the container support element and configured to activate the container support element in response to a dismounting motion of the cover relative to the cover receiving portion, and the guide means may be structured to displace an activated container support element in a distal direction relative to the cover receiving portion.

Such a construction will e.g. lead the container (and the first actuation element portion being coupled with the movable wall) axially in the opposite direction of the cover (and the second actuation element portion being coupled with the cover) during dismounting of the cover from the cover receiving portion, whereby a smaller axial movement of the cover relative to the cover receiving portion is needed to extend the actuation element to the second axial dimension. If the relative motion between the cover and the cover receiving portion is defined by a threaded interface, this means that the threaded interface may be designed such that the relative angular displacement between the cover and the cover receiving portion required to dismount the cover from the cover receiving portion is reduced, thereby increasing the user convenience of the device, as a user may only have to turn the cover e.g. one full revolution instead of e.g. two full revolutions to expose the container for operation.

The relative motion between the cover and the cover receiving portion may be defined by a first threaded section having a first pitch, and an activated container support element may undergo a relative helical motion with respect to the cover or the cover receiving portion which is defined by a second threaded section having a second pitch, said second pitch being greater than the first pitch.

Compared to a construction having first and second threaded sections of the same pitch this will provide an augmentation of the axial displacement of the container relative to the cover receiving portion and will thereby allow for an even further reduction of the relative angular displacement between the cover and the cover receiving portion required to extend the actuation element to the second axial dimension and to dismount the cover from the cover receiving portion. In other words, the user convenience of the device may be increased even more, as in this case a user may only have to turn the cover e.g. half a revolution instead of e.g. two full revolutions to expose the container for operation.

The cover may be a protective cap forming part of an enclosure for the container. Thereby, a controlled internal environment may be established to reduce or eliminate the risk of the fluid medium being exposed to impurities. In particular embodiments the cover is a rigid cap adapted to form part of an at least partly rigid enclosure for the container. Such an enclosure further allows a user to bring the device about in e.g. a pocket or a handbag without having to fear that an interaction with other contents thereof might cause an unintended activation of the container.

The extendable actuation element solution is particularly applicable in a medical device of the fluid transfer device type disclosed in connection with any of the other aspects of the invention, i.e. in a device which further comprises a reservoir adapted to hold a substance to be mixed with the fluid medium, and a fluid connection unit adapted to establish a fluid communication between the container and the reservoir. Particularly, the reservoir may be arranged distally of the container, and the fluid connection unit may be arranged at least partially between the container and the reservoir.

Thus, in a further aspect of the invention a medical device is provided comprising a syringe holding a first medium, the syringe comprising a syringe barrel having a tip portion defining a syringe outlet, a slidable piston arranged in the syringe barrel, and a piston rod adapted to displace the piston in the syringe barrel, a penetrable syringe tip cap for sealing the syringe outlet, a vial holding a second medium, the vial being axially aligned with the syringe and having a neck portion defining a vial outlet, and a penetrable vial stopper for sealing the vial outlet, a coupling element comprising a vial holding portion adapted to receive and hold the vial, and a cover receiving portion, a cover releasably mounted on the cover receiving portion to shield at least a portion of the piston rod, the cover and the cover receiving portion being configured for relative motion along a first helical path, a fluid connection unit arranged axially between the syringe and the vial and comprising a transversal base, a first pointed structure extending in a first direction from the transversal base for penetrating the syringe tip cap, and a second pointed structure extending in a second direction from the transversal base for penetrating the vial stopper, a syringe holder for retaining the syringe, the syringe holder being rotationally locked with respect to the coupling element and configured for relative motion with respect to the cover along a second helical path such that a rotation of the cover relative to the cover receiving portion causes a translational movement of the syringe holder towards the vial, wherein the piston rod comprises a first piston rod portion and a second piston rod portion axially displaceable with respect to the first piston rod portion from a first relative position, defining an initial state of the piston rod, to a second relative position, defining an extended state of the piston rod, and wherein the first piston rod portion is coupled with the piston and the second piston rod portion is coupled with the cover such that the first piston rod portion and the second piston rod portion undergo relative motion from the first relative position to the second relative position in response to a dismounting of the cover from the cover receiving portion.

U.S. Pat. No. 5,466,220 also discloses a drug vial mixing and transfer device comprising a vial and a syringe arranged head-to-head. The syringe holds a cannula for piercing the vial and thereby establishing fluid communication between the vial interior and the syringe interior. A plunger within the syringe is operable to transfer fluid between the syringe and the vial. Following a reconstitution procedure the syringe is removed from the vial and used to administer the drug. While this device overcomes some of the drawbacks of the traditional way of mixing substances it offers no flexibility with respect to the type of delivery means to be employed, as the cannula is fixed to the syringe. The user can therefore not use e.g. an infusion set for IV administration should she/he so desire. Furthermore, the cannula may become blunted by the piercing of the vial during the establishment of the fluid communication between the syringe and the vial. This may cause discomfort to the user during the subsequent skin penetration.

WO 97/46203 also discloses a needle assembly for use with a prefilled syringe. The needle assembly is fitted over a vial and includes a Luer fitting for reception of the syringe. The Luer fitting is initially kept sterile with a film seal which is adapted to be peeled off or pierced by the syringe nozzle before attachment of the syringe to the Luer fitting. Following attachment of the syringe and transfer of fluid between the syringe and the vial, the syringe is removed from the needle assembly and a separate injection needle is fastened to the syringe for administration of the drug. While this arrangement may offer greater flexibility with respect to the use of delivery means for providing access and delivery to the body, it includes at least one additional step of attaching a syringe to the assembly before reconstitution can be performed. Each added step in the mixing procedure may cause a loss of valuable time for the person in need of a fast administration.

In view thereof, it is a further object of the invention to provide an arrangement for fast and easy readying of a medical applicator, such as e.g. a syringe. In particular, it is an object to provide an arrangement by which a medical applicator is automatically readied for attachment of suitable delivery means upon removal from a dedicated holder and, further, to provide a fluid transfer device, such as e.g. a mixing device, incorporating such an arrangement.

Thus, in a further aspect of the invention a medical arrangement is provided comprising a medical applicator defining a general axis and having an outlet through which a volume of a substance is transferable, a support member for holding the medical applicator, and a closure member for sealing the outlet. The closure member is removably attached to the medical applicator and the medical applicator is arranged removably in the support member. Furthermore, the closure member is arranged irremovably with respect to the support member.

Such an arrangement enables a fast readying of the medical applicator for drug delivery because when the medical applicator is removed from the support member the closure member remains with the closure member. An infusion set or a cannula, or other suitable delivery means selected by the user according e.g. to the specific recommended compartment of administration, may then be connected to the exposed outlet for ready access to the body.

The closure member may be locked to the support member via a bi-directional translational coupling with a closure retaining element which is itself rotationally and translationally locked to the support member. The closure member may further be rotationally locked to the support member. Alternatively, the closure member may be locked directly to the support member.

The closure member may comprise an elastic material with a high sealing capacity, such as e.g. rubber, whereas the closure retaining element may comprise a more rigid material for ensuring a sufficient engagement between the two.

The closure retaining element may comprise reception means for receiving the outlet of the medical applicator. In some embodiments, the reception means comprises a threaded section structured for mating engagement with a threaded Luer connector surrounding the outlet. In other embodiments, the reception means comprises a collar adapted for engagement with a Luer taper in a Luer-Slip type fitting.

In a further aspect of the invention a fluid transfer device incorporating the medical arrangement according to the previous aspect of the invention is provided. The fluid transfer device may further comprise a container co-axially aligned with the medical applicator, the container comprising an opening and a container closure for the opening. Fluid connection means may be arranged at least partially between the medical applicator and the container and may comprise a first penetration member for penetrating the closure member, a second penetration member for penetrating the container closure, and a lumen extending through the first penetration member and the second penetration member. Furthermore, spacer means may be provided structured to enable a relative axial motion between the medical applicator and the container from a first position in which the medical applicator and the container are fluidly unconnected to a second position in which the first penetration member has penetrated the closure member and the second penetration member has penetrated the container closure to thereby establish fluid communication between the medical applicator and the container.

Such a fluid transfer device may be used for mixing substances, e.g. for mixing liquids or for reconstitution of a powder using a solvent, to obtain an administrable drug. The medical applicator may be a prefilled syringe and the fluid transfer device including the medical arrangement may be pre-assembled by the manufacturer. In that case an easy to use device with few manual operating steps may be provided.

The spacer means may comprise a spacer means thread adapted for mating engagement with a support member thread on the support member, providing for a helical advancement of the support member, and thereby the medical applicator, relative to the spacer means.

The fluid transfer device may further comprise drive means for causing the relative axial motion between the medical applicator and the container from the first position to the second position. Such drive means may comprise a drive element adapted to engage with the medical applicator or the support member and rotate the medical applicator or the support member relative to the spacer means. In particular embodiments, the drive element comprises a cover member adapted to cover at least an operable portion of the medical applicator before use thereof. The cover is then rotationally coupled with the medical applicator, e.g. via the support member.

In case the medical applicator is releasably locked to the reception means via a Luer lock type fitting the cover may be structured to rotate the support member in a direction which fastens the Luer lock connection. Thereby, it is ensured that the medical applicator rotates with the support member during the activation thereof by the cover.

After establishment of fluid communication between the medical applicator and the container, transfer of liquid from the medical applicator to the container, mixing of substances in the container, and transfer of an administrable drug from the container to the medical applicator, the medical applicator may simply be unscrewed from the reception means, whereby the closure member will automatically be retained in the device due to its fixation to the support member. The closure member is therefore automatically removed from the outlet when the medical applicator is released from the support member to allow the user to quickly attach a desired delivery means.

In a further aspect of the invention an assembly is provided comprising a first container comprising a variable volume chamber holding a first medium, reception means adapted to receive and retain a second container holding a second medium, and fluid connection means for establishing fluid connection between the first container and the second container, when the second container is retained by the reception means. The assembly further comprises a cover receiving portion and a cover removably mounted thereon to shield at least a portion of the first container. The cover is operatively coupled with the fluid connection means and configured to cause a relative converging motion between at least one of a) the first container and the fluid connection means and b) the reception means and the fluid connection means in response to a dismounting of the cover from the cover receiving portion.

In a further aspect of the invention an assembly is provided comprising a first container holding a first medium and defining a general axis, reception means for mechanical coupling with a second container holding a second medium, and fluid connection means for establishing fluid connection between the first container and the second container, when the second container is coupled with the reception means, the fluid connection means being arranged at least partially between the first container and the reception means. The assembly further comprises a cover receiving portion and a cover removably mounted thereon to shield at least an operable portion of the first container. Guide means are also provided, the guide means being structured to guide a relative motion between the first container and the reception means from a first relative position in which the first container and the reception means are spaced apart a first axial distance to a second relative position in which the first container and the reception means are spaced apart a second axial distance, the second axial distance being smaller than the first axial distance. The cover is operatively coupled with the first container so as to cause a relative motion between the first container and the reception means from the first relative position to the second relative position in response to a relative motion between at least a portion of the cover and the cover receiving portion.

The assembly is suitable for use in combination with a second container in a medium transfer arrangement as described in the above.

In particular embodiments, the reception means is structured to co-axially align the second container with the first container to thereby provide a slender configuration of the assembly.

The reception means may comprise a snap structure, or other suitable engagement structures, adapted to receive and retain a dedicated portion of the second container. Such a snap structure may comprise a number of deflectable elastic arms, each arm being supported at one end by e.g. the coupling element, on which the cover receiving portion is arranged, and having a hook member at the opposite end for engaging the second container. Such a design would allow the user to e.g. place the second container on a flat surface and snap the assembly over it, to thereby provide a medical device as described in connection with the previous aspects of the invention, before commencing a removal of the cover from the cover receiving portion.

The device and the assembly according to the invention are particularly applicable for mixing liquids as well as for reconstituting a powder using a solvent. Non-exhaustive examples of suitable drugs which may be provided in a powdered form include various factor products for use in the treatment of haemophilia, growth hormone, antibiotics and fertility drugs.

In the present specification, reference to a certain aspect or a certain embodiment (e.g. "an aspect", "a first aspect", "one embodiment", "an exemplary embodiment", or the like) signifies that a particular feature, structure, or characteristic described in connection with the respective aspect or embodiment is included in, or inherent of, at least that one aspect or embodiment of the invention, but not necessarily in/of all aspects or embodiments of the invention. It is emphasized, however, that any combination of features, structures and/or characteristics described in relation to the invention is encompassed by the invention unless expressly stated herein or clearly contradicted by context.

The use of any and all examples, or exemplary language (e.g., such as, etc.), in the text is intended to merely illuminate the invention and does not pose a limitation on the scope of the same, unless otherwise claimed. Further, no language or wording in the specification should be construed as indicating any non-claimed element as essential to the practice of the invention.

BRIEF DESCRIPTION OF THE DRAWINGS

In the following the invention will be further described with references to the drawings, wherein.

In the figures like structures are mainly identified by like reference numerals.

DESCRIPTION OF EXEMPLARY EMBODIMENTS

When in the following relative expressions, such as "upwards" and "downwards", are used, these refer to the appended figures and not necessarily to an actual situation of use. The shown figures are schematic representations for which reason the configuration of the different structures as well as their relative dimensions are intended to serve illustrative purposes only.

Figure 1:
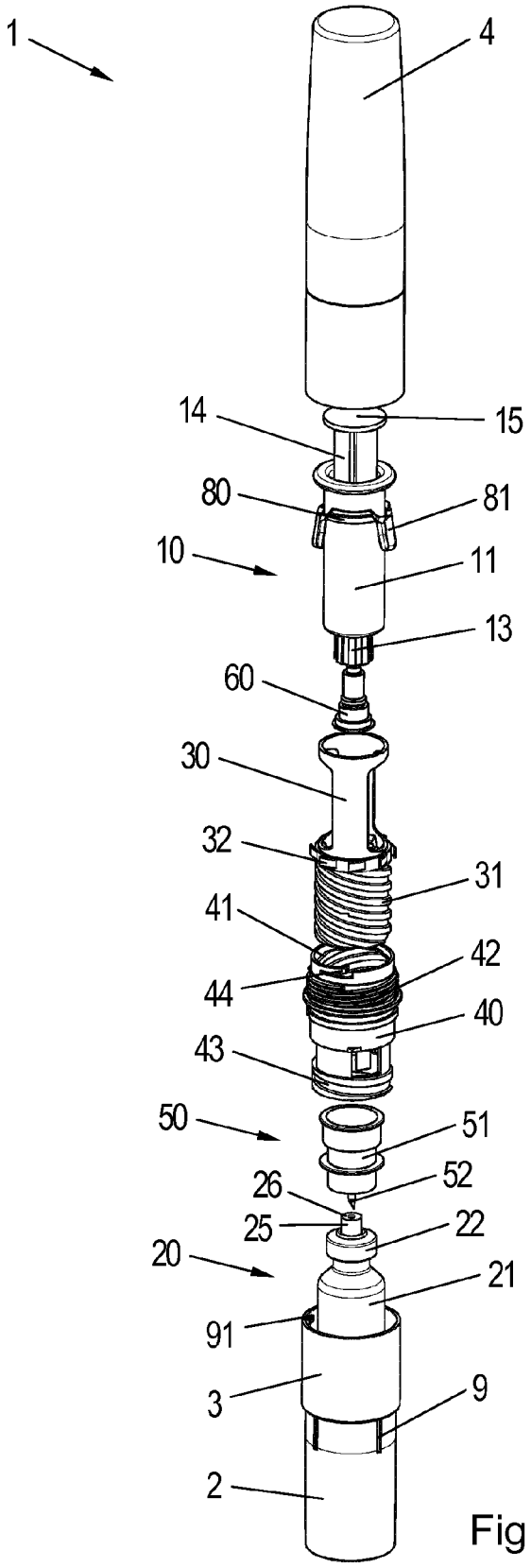
FIG. 1 is an exploded view of a drug mixing arrangement according to an embodiment of the invention.

FIG. 1 is an exploded perspective view of a mixing device 1 for reconstitution of a powdered drug in a vial 20 using a solvent from a syringe 10. The vial 20 comprises a wall 21 having an opening which is sealed by a vial stopper 23 (not visible in this view) and a seal cap 22. The vial 20 is arranged in a vial holder 2 which serves to position and protect the vial 20. A lock ring 3 is fitted over a portion of the vial holder 2 and locked against rotation relative to the vial holder 2 via a longitudinal internal rib (not visible) engaging a longitudinal groove 9 in the outer surface of the vial holder 2. A tower 25 protrudes axially from the seal cap 22 in the direction away from the vial 20. The tower 25 has an inner circumferential sealing rim 26 at its end portion, the purpose of which is explained below.

In the disclosed embodiment the wall 21 is made of glass and the vial holder 2 is made of a transparent plastic. Other suitable materials may, however, be chosen depending on the specific application of the mixing arrangement 1.

The lock ring 3 is connected to a coupling element 40 via a cam 91 on the interior surface of the lock ring 3 and a cam receiving bayonet groove (not visible) in an exterior surface of the coupling element 40. In the pre-assembled state of the mixing device 1 the cam 91 is positioned at the end of the bayonet groove, whereby the lock ring 3 and the coupling element 40 are prevented from relative translational motion but allowed to undergo a limited relative rotation.

The coupling element 40 is a tubular sleeve which further comprises an exterior thread 43 at its distal end portion for engagement with an interior thread 7 (not visible in this view) in the vial holder 2, and an interior thread 41 at its proximal end portion for engagement with an exterior thread 31 of a syringe holder 30. The interior thread 41 ends at a flexible lock arm 44, the purpose of which is described in detail below. The coupling element 40 also has an exterior thread 42 arranged proximally of the exterior thread 43. The pitch of the interior thread 41 is greater than the pitch of the exterior thread 42.

The syringe holder 30 has a proximal portion adapted to receive and hold a portion of the syringe 10, and a distal portion which carries the exterior thread 31 and which is designed to accommodate a connector piece 50 comprising a sleeve body 51 and a distally pointing hollow spike member 52. A number of ratchet arms 32 are arranged equidistantly along the circumference of a central portion of the syringe holder 30. The purpose of these ratchet arms 32 will be clear from the below.

The syringe 10 comprises a barrel 11, the outlet of which is surrounded by a threaded Luer collar 13 and sealed by a syringe stopper 60. A user manipulable piston rod 14 having a push face 15 for easy operation is adapted to drive a piston 19 (not visible in this view) inside the barrel 11. At its proximal end portion the barrel 11 holds a flange carrier 80 provided with opposite spreadable wings 81 for offering a more ergonomic grip of the syringe 10.

A cap 4 is adapted to cover the syringe 10 during storage and transportation of the mixing device 1 to prevent operation of the piston rod 14 and thereby to ensure that pressure is not prematurely applied to the contents of the syringe 10. The cap 4 has an interior thread 5 (not visible in this view) adapted to engage with the exterior thread 42 for positioning of the cap 4 relative to the coupling member 40.

Figure 2:
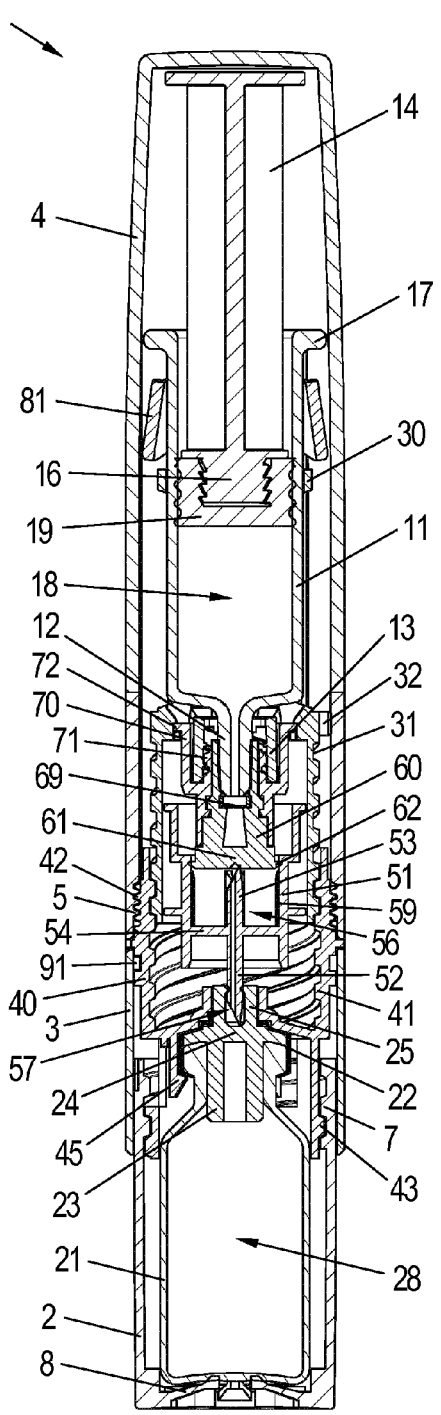
FIG. 2 is a longitudinal section view of the arrangement of FIG. 1, in a pre-use state.

FIG. 2 is a longitudinal section view of the mixing device 1 in the assembled state, prior to a first use thereof, showing further details of the arrangement. This state corresponds to the one in which the mixing device 1 is intended to be delivered by the manufacturer. The piston rod 14 is in a retracted position in the barrel 11, thereby defining a syringe interior 18 capable of holding a certain volume of a solvent (not shown). The piston rod 14 is coupled firmly to the piston 19 via a jagged coupling head 16. The cap 4 is fitted snugly around a collar 17 at the proximal end of the syringe 10 and the wings 81 are folded down along the barrel 11. This provides a user friendly slender configuration of the mixing device 1.

A Luer 12, defining an outlet of the syringe 10, protrudes into the distal portion of the syringe holder 30 and is retained therein via a screw thread connection between the Luer collar 13 and a threaded inner portion 71 of a stopper retainer 70. A couple of protrusions 72 are provided on the stopper retainer 70 to rotationally lock the stopper retainer 70 with respect to the syringe holder 30. This is described in more detail in connection with FIG. 6. A lock snap 74 on the syringe holder 30 is engagement with the protrusions 72 to provide a bi-directional translational coupling between the stopper retainer 70 and the syringe holder 30. A portion of the syringe stopper 60 is wedged between the Luer 12 and the threaded inner portion 71 and thereby provides a fluid tight engagement with the exterior surface of the Luer 12. The syringe stopper 60 carries a filter 69 for filtering out any impurities of a passing liquid and has a penetrable section 61 allowing for easy rupturing of the syringe sealing by a suitable tool.

The connector piece 50 is slidably received in the hollow interior of the distal portion of the syringe holder 30. The sleeve body 51 supports a transverse spike base 54 which carries the distally pointing hollow spike member 52 as well as a proximally pointing hollow spike member 53. In the depicted state of the mixing device 1 the hollow spike member 53 is arranged just distally of the penetrable section 61 and the hollow spike member 52 is arranged just proximally of a penetrable section 24 of the vial stopper 23. The syringe 10 and the vial 20 are therefore fluidly unconnected at this point. The syringe stopper 60 has at its distal end a circumferential sealing lip 62 which is adapted to sealingly engage with an interior portion of the sleeve body 51 to provide a fluid tight compartment 56 for the hollow spike member 53. Similarly, the tower 25 with the sealing rim 26 provides a fluid tight compartment 57 for the hollow spike member 52. This particular construction thus enables the incorporation of a sterilised sub-assembly comprising the syringe stopper 60, the connector piece 50 and the vial stopper 23 during assembly of the mixing device 1, and further ensures that sterility of the respective hollow spike members 52, 53 is maintained throughout storage, transportation and use of the mixing device 1 with no need for additional sterile barriers.

One or more vents 59 are provided in the sleeve body 51 to allow gas, e.g. air, entrapped within the sterile compartment 56 to escape during establishment of fluid connection between the syringe 10 and the vial 20, as will be explained in more detail below.

The coupling element 40 has a number of circumferentially spaced apart catch arms 45 extending downwards from a transversal portion at the end of the interior thread 41 for securing firm attachment of the vial 20. The wall 21 defines a vial interior 28 capable of holding an amount of powdered drug (not shown) to be reconstituted by the solvent from the syringe 10. The wall 21 is flexibly supported by leaf springs 8 in the bottom of the vial holder 2 to account for manufacturing tolerances.

Figure 3:
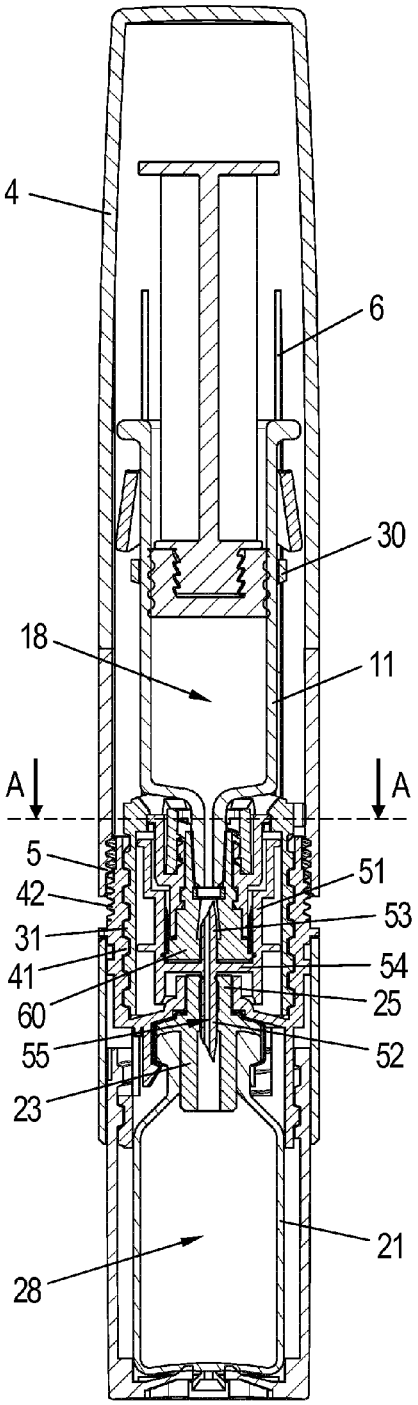
FIG. 3 is a longitudinal section view of the arrangement after fluid connection is established between the included reservoirs.

FIG. 3 shows the mixing device 1 after unscrewing of the cap 4 from the exterior thread 42 and an automatically effected establishment of fluid connection between the syringe interior 18 and the vial interior 28. The cap 4 still covers the syringe 10, although now the cap 4 can be easily removed by simply pulling it away from the coupling element 40.

Axially extending ribs 6 are arranged on an interior surface of the cap 4 for engagement with the ratchet arms 32, providing for a unidirectional rotational coupling between the cap 4 and the syringe holder 30, ensuring that the cap 4 and the syringe holder 30 are locked against relative rotation during unscrewing of the cap 4 from the exterior thread 42. The exterior thread 42 is a right-hand thread and the interior thread 41 is a left-hand thread, so when the cap 4 is unscrewed from the exterior thread 42, and the cap 4 thereby is moved axially away from the coupling element 40, the exterior thread 31 is screwed further into the interior thread 41, whereby the syringe holder 30 is moved axially in the opposite direction towards the vial 20, while the ratchet arms 32 slide along the ribs 6. Because the pitch of the interior thread 41 is greater than the pitch of the exterior thread 42 the syringe holder 30, and thereby the syringe 10, moves axially a longer distance towards the vial 20 than the cap 4 moves away from the coupling element 40 during unscrewing of the cap 4 from the exterior thread 42. The pitch difference in the present embodiment is designed to move the exterior thread 31 to the end of the interior thread 41, and thereby to establish a fluid connection between the syringe 10 and the vial 20, upon less than one full revolution of the cap 4 relative to the coupling element 40.

As can be seen from the figure, in this state of the mixing device 1 the hollow spike member 52 has penetrated the penetrable section 24 and entered partly into the vial interior 28 and the hollow spike member 53 has penetrated the penetrable section 61 and entered partly into a chamber provided in the syringe stopper 60 between the penetrable section 61 and the filter 69. The syringe interior 18 and the vial interior 28 are thereby in fluid communication via a lumen 55 extending through the respective spike members 52, 53 and the spike base 54.

Figure 4:
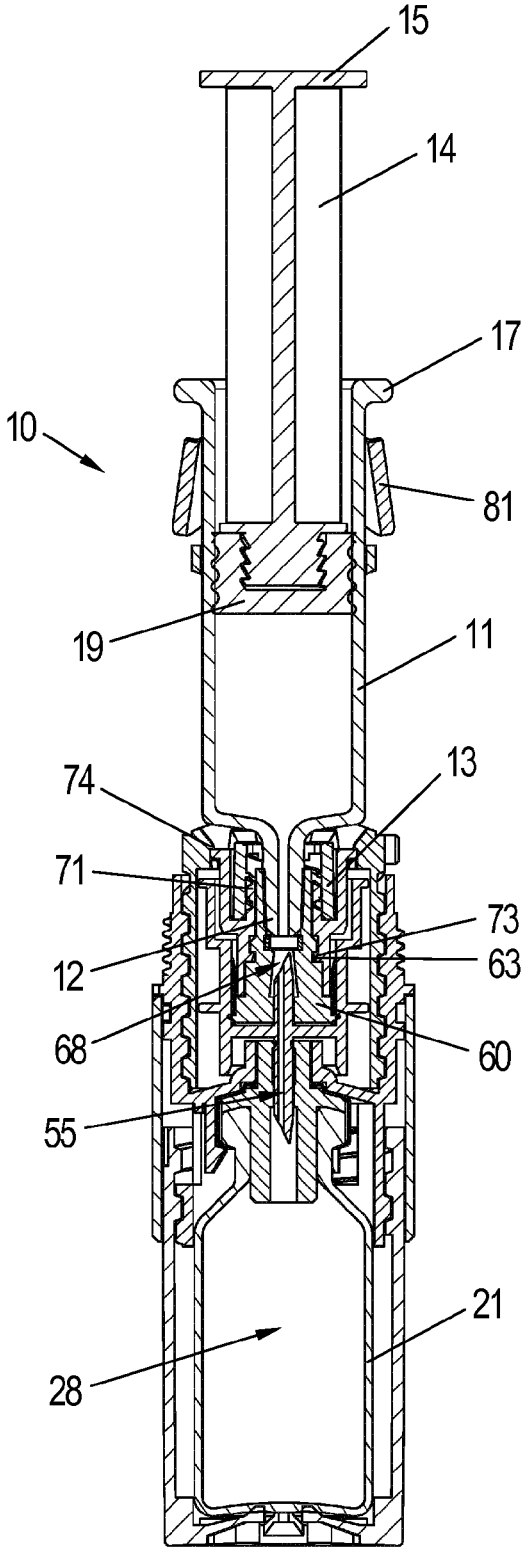
FIG. 4 is a longitudinal section view of the arrangement after complete removal of the cover.

In FIG. 4 the cap 4 has been removed from the coupling element 40 and the piston rod 14 is operable for firstly driving the solvent out of the syringe 10 and into the vial 20 and subsequently withdrawing the reconstituted product from the vial 20 back into the syringe 10.

Figure 5:
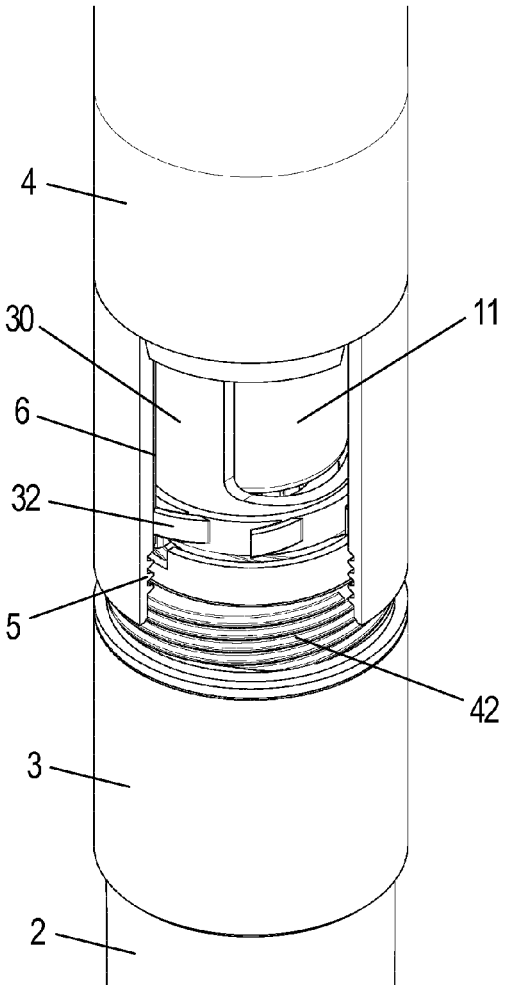
FIG. 5 is a close-up perspective view of a mechanical connection between the cover and the syringe holder.

FIG. 5 is a close-up perspective view of a portion of the mixing device 1 showing the operative coupling between the cap 4 and the syringe 10. For the sake of clarity a portion of the cap 4 has been cut away to reveal the engagement of one of the ratchet arms 32 with one of the ribs 6. This ratchet mechanism will cause the cap 4 to slave the syringe holder 30, and thereby the syringe 10, when turned in the counter-clockwise direction, whereas the ribs 6 will ride over the ratchet arms 32 when the cap 4 is turned in the clockwise direction, enabling relative rotational movement between the cap 4 and the syringe holder 30 when the cap 4 is screwed onto the exterior thread 42.

Figure 6:
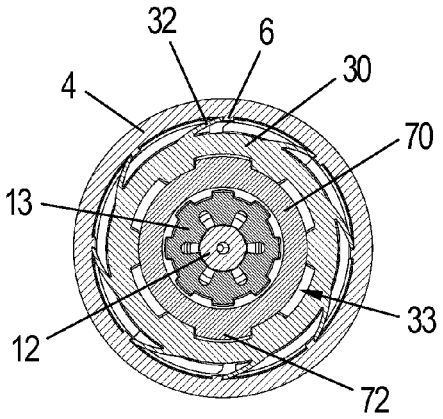
FIG. 6 is a transverse section view along line A-A of FIG. 3, FIGS. 7*a* and 7*b* are longitudinal section views illustrating an operative connection between a cover and a syringe holder in a drug mixing arrangement according to another embodiment of the invention.

FIG. 6 is a transverse section view along line A-A of FIG. 3, showing more clearly the interaction between the ribs 6 and the ratchet arms 32. It further shows the rotational lock between the syringe holder 30 and the stopper retainer 70. As can be seen the protrusions 72 fit into respective indentations 33 in the central portion of the syringe holder 30, whereby the stopper retainer 70 is forced to follow any rotational motion of the syringe holder 30.

Figure 7A:
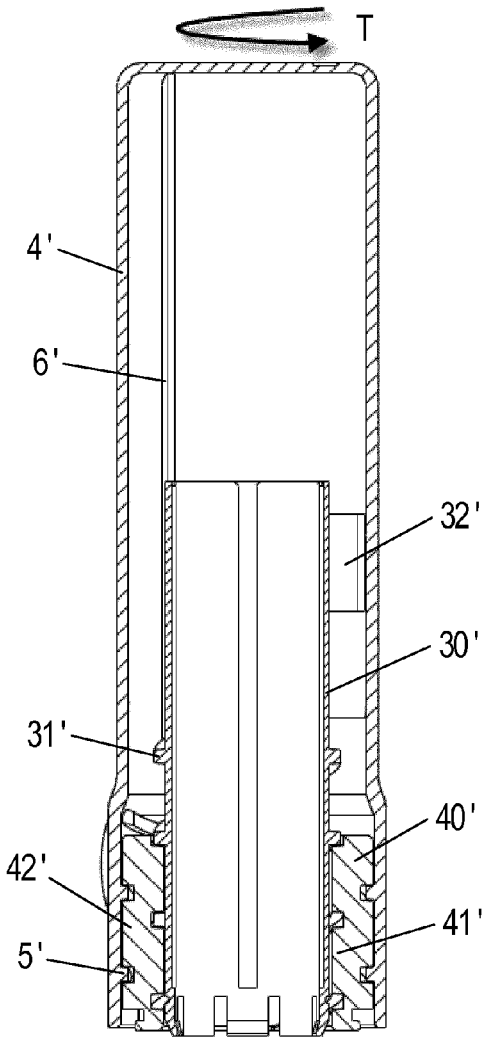
Figure 7B:
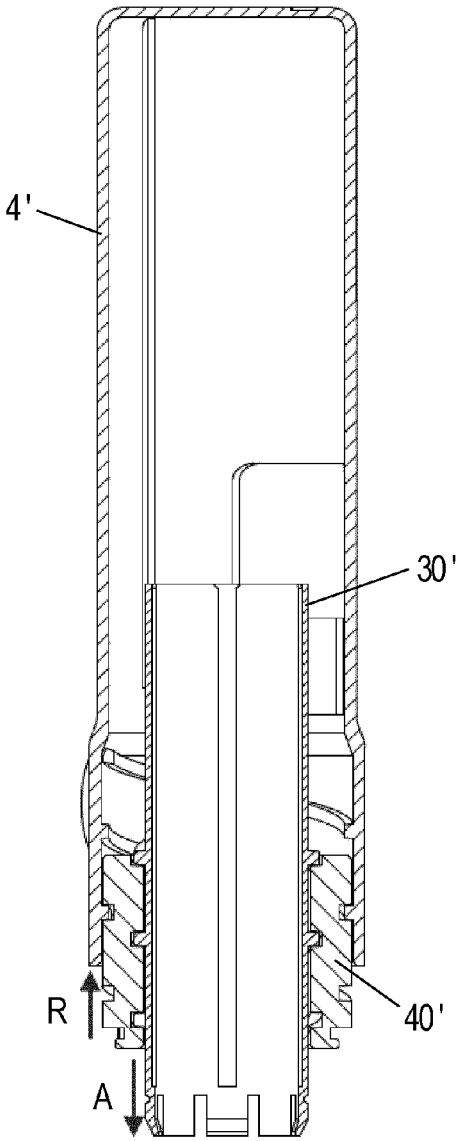

FIGS. 7*a* and 7*b* sketch the operative coupling between a cap 4' and a container holder 30' via a coupling element 40' in relation to a mixing device according to an alternative embodiment of the invention. For the sake of clarity both receptacles have been left out of these illustrations, but it is clear that during normal use the container holder 30' carries a substance holding receptacle in line with what is described in connection with the previous embodiment. The principle of the operative coupling between the cap 4' and the container holder 30' is the same as between the cap 4 and the syringe holder 30, except that in this embodiment there is a 1:1 relationship between axial movements of the cap 4' and the container holder 30' during unscrewing of the cap 4' from the coupling element 40'.

The cap 4' has an internal thread 5' structured for mating engagement with an external thread 42' on the coupling element 40', and the container holder 30' has an external thread 31', of the same pitch as that of the internal thread 5', structured for mating engagement with an internal thread 41' in the coupling element 40'. The container holder 30' is further provided with a flange 32' adapted for sliding abutment with a rib 6' on the inner surface of the cap 4'. When the cap 4' is caused to perform a counter-clockwise rotation in the direction T relative to the coupling element 40' the rib 6' abuts the flange 32' and slaves the container holder 30' in the same direction. The interior thread 41' is a left-hand thread and the exterior thread 42' is a right-hand thread, so when the cap 4' is thus rotated counter-clockwise relative to the coupling element 40' the cap 4' moves axially upwards in the direction R, while the container holder 30' moves axially downwards in the direction A.

Figure 8:
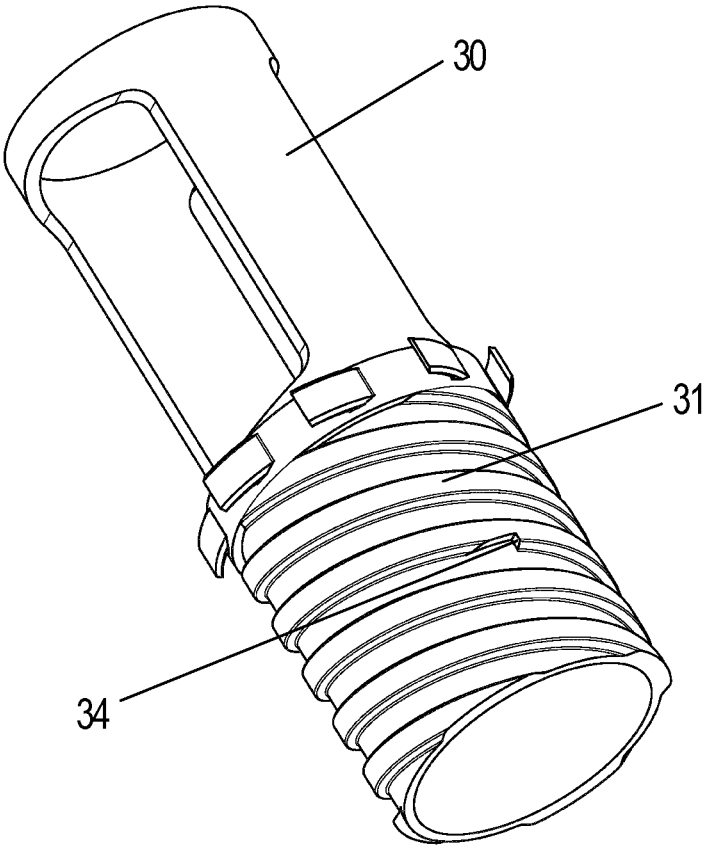
FIG. 8 is a perspective view of a syringe holder for use in the arrangement of FIG. 1.

FIG. 8 is a perspective view of the syringe holder 30 showing a notch 34 approximately half-way down the thread 31. The notch 34 is adapted for engagement with the flexible lock arm 44 during assembly of the mixing device 1 when the exterior thread 31 is screwed into the interior thread 41 and serves specifically to position the syringe holder 30 relative to the coupling element 40. When the flexible lock arm 44 slides along the distal most portion of the exterior thread 31 during the initial engagement it is deflected out of its relaxed state, and when it reaches the notch 34 it abruptly returns to the relaxed state, preventing a reverse relative rotational motion between the syringe holder 30 and the coupling element 40 beyond that point. Thereby, the exact axial position of the syringe holder 30 relative to the coupling element 40 can be determined in the assembly process which again provides for a correct axial positioning of the ratchet arms 32 relative to the ribs 6.

Figure 9:
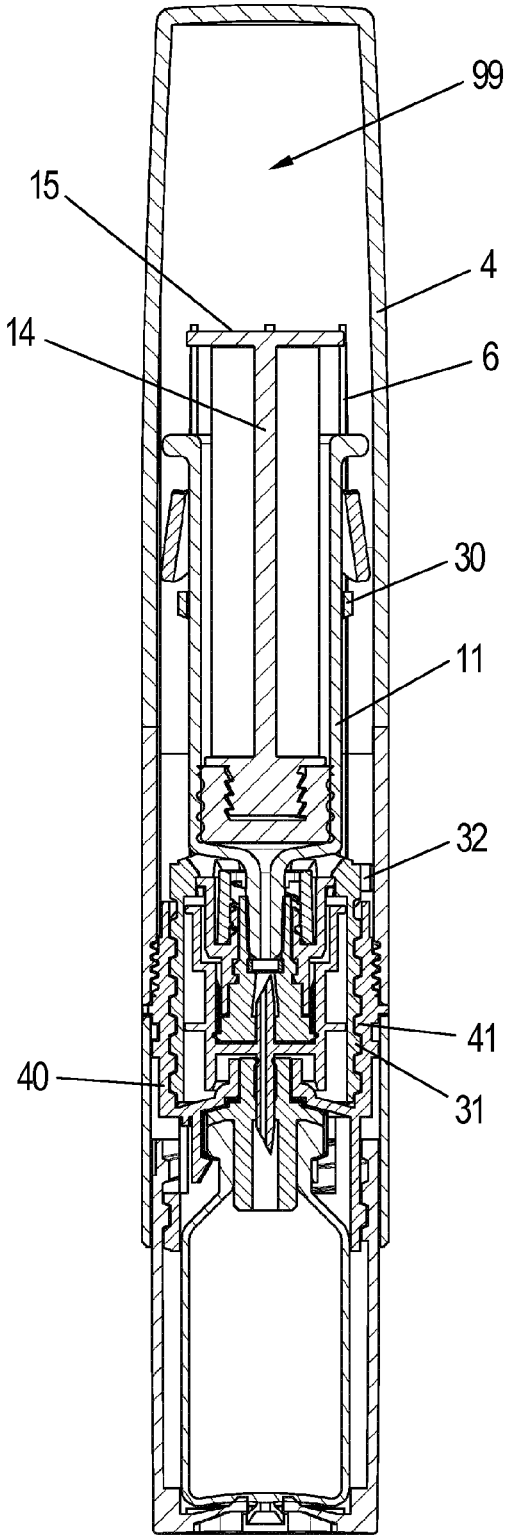
FIG. 9 is a longitudinal section view of the arrangement of FIG. 1 after re-mounting of the emptied syringe and the cover.

FIG. 9 is a longitudinal section view of the mixing device 1 after use, i.e. after mixing of the solvent and the powdered drug and parenteral delivery of the final product from the syringe 10 via suitable delivery means such as an infusion set or a cannula. The syringe 10 has been re-inserted in the syringe holder 30 and the cap 4 has been re-mounted onto the coupling element 40. Since the syringe 10 is now empty only a small portion of the piston rod 14 projects from the barrel 11 which leaves a free storage space 99 between the push face 15 and the proximal portion of the cap 4. The storage space 99 is intended for reception of items used in connection with the administration of the drug, particularly of the used delivery means. The mixing device 1 is therefore applicable as a sharps container after use.

Operation of the Mixing Device Represented by FIGS. 1-9

In the following a situation of use of the mixing device 1 will be described. In order to gain access to the piston rod 14 a subject user grips the lock ring 3 and holds it between two or more fingers of one hand. She or he then grips the cap 4 with the other hand and makes a turning motion to unscrew the interior thread 5 from the exterior thread 42. The cap 4 will be released from the coupling element 40 upon less than one full relative revolution. During the relative rotation of the cap 4 and the coupling element 40 the ribs 6 engage the ratchet arms 32 to thereby slave the syringe holder 30. Due to the interior thread 41 being a left-hand thread and the exterior thread 42 being a right-hand thread, the syringe holder 30 is forced downwards towards the vial 20 as the cap 4 moves upwards away from the lock ring 3. The engagement between the lock snap 74 and the protrusions 72 will cause the stopper retainer 70 to move downwards with the syringe holder 30, and since the syringe 10 is threadedly coupled with the stopper retainer 70 via the Luer collar 13 and the threaded inner portion 71 the syringe 10 will be forced to follow the downward movement of the syringe holder 30.

The connector piece 50 is held in the distal portion of the syringe holder 30 by a friction fit and as the exterior thread 31 travels along the interior thread 41 during the relative rotational motion between the cap 4 and the coupling element 40, and the syringe 10 and the vial 20 are thereby gradually brought closer to one another, the connector piece 50 will move further into the distal portion of the syringe holder 30. During the travel of the exterior thread 31 in the interior thread 41 the hollow spike member 52 will be pressed against the penetrable section 24 and the hollow spike member 53 will be pressed against the penetrable section 61. Further converging motion of the syringe 10 and the vial 20 will eventually cause the hollow spike member 52 to penetrate the penetrable section 24 and the hollow spike member 53 to penetrate the penetrable section 61 to thereby establish fluid communication between the syringe interior 18 and the vial interior 28. When the exterior thread 31 has travelled to the end of the interior thread 41 the hollow spike member 52 resides within a hollow of the vial stopper 23 distally of the penetrable section 24, and the hollow spike member 53 resides within a space 68 in the syringe stopper 60 delimited by the penetrable section 61 and the filter 69. In the course of entry of the hollow spike member 53 into the space 68 the circumferential sealing lip 62 slides along the interior wall of the sleeve body 51. One or more vents 59 in the form of axially extending ribs on the interior wall of the sleeve body 51 allow the compressed air in the compartment 56 to escape as the syringe stopper 60 is moved into abutment with the spike base 54. The vents 59 extend from the spike base 54 and end just distally of the initial, pre-use position of the syringe stopper 60. Thereby, the compartment 56 can be maintained sterile until use of the mixing device 1, while the syringe stopper 60 during use can be moved relative to the sleeve body 51 without resistance from entrapped air.

The thread engagement between the exterior thread 42 and the interior thread 5 is longer than the thread engagement between the exterior thread 31 and the interior thread 41, so when the exterior thread 31 has travelled to the end of the interior thread 41 and fluid communication has been established between the syringe interior 18 and the vial interior 28 via the lumen 55 the cap 4 is still not released from the coupling element 40. Hence, it is guaranteed that the user cannot accidentally apply pressure to the syringe interior 18 through operation of the piston rod 14 until fluid communication is properly established between the syringe 10 and the vial 20.

During subsequent dismounting movement of the interior thread 5 along the exterior thread 42, the engagement between the ribs 6 and the ratchet arms 32 will still transfer the rotation of the cap 4 to the syringe holder 30. However, as the exterior thread 31 is no longer capable of relative motion with respect to the interior thread 41, the syringe holder 30 and the coupling element 40 are forced to perform a joint rotational motion relative to the lock ring 3. This is enabled by the cam 91 moving in the bayonet groove in the exterior surface of the coupling element 40. The rotation of the coupling element 40 relative to the lock ring 3 causes a relative rotational motion between the coupling element 40 and the vial holder 2. Because the coupling element 40 is prevented from translational motion relative to the lock ring 3 and because the vial holder 2 is prevented from rotating relative to the lock ring 3 this relative rotational motion between the coupling element 40 and the vial holder 2 causes the interior thread 7 to travel along the exterior thread 43, whereby the vial holder 2 is forced upwards towards the syringe holder 30. Thereby, the connection between the vial 20 and the coupling element 40 is tightened because the vial holder 2 presses the vial 20 against the transversal portion of the coupling element 40. This eliminates the risk of production tolerances being the cause of a loose connection between the hollow spike member 52 and the vial 20.

The joint rotation of the syringe holder 30 and the coupling element 40 is relatively small as it corresponds to the last part of the rotation of the cap 4 that releases the interior thread 5 from the exterior thread 42. When the cap 4 is released from the exterior thread 42 it can be removed to expose the syringe 10 for operation. At this point the user holds the mixing device 1 such that the syringe 10 faces upwards. By depression of the piston rod 14 the piston 19 is advanced in the barrel 11 to force the solvent out through the Luer 12, further through the lumen 55 and into the vial 20, where it mixes with the powdered drug. The mixing device 1 is then turned up-side down and the piston rod 14 is gradually released to allow the built up pressure in the vial 20 to cause or assist a transfer of the mixed product out of the vial 20, through the lumen 55 and into the syringe 10. Alternatively, or additionally, the piston rod 14 is pulled backwards in the barrel 11 to cause or assist the transfer of the mixed product from the vial 20.

Once the mixed product is fully contained within the syringe 10, the syringe 10 is removed from the rest of the arrangement. This is done by gripping the syringe holder 30 with one hand and the collar 17 with the other hand and then rotating the syringe 10 relative to the syringe holder 30. Because of the locking engagement between the protrusions 72 and the indentations 33 when the syringe 10 is rotated relative to the syringe holder 30 the Luer collar 13 is screwed out of engagement with the threaded inner portion 71. A circumferential groove 63 in the syringe stopper 60 is engaged by a mating ridge 73 on the stopper retainer 70 to lock the syringe stopper 60 against axial movement relative to the stopper retainer 70. Thereby, when the Luer collar 13 is released from the threaded inner portion 71 the syringe 10 can be easily removed from the stopper retainer 70, leaving the syringe stopper 60 in the remaining part of the mixing device 1. Thus, the syringe 10 is ready for connection with e.g. a cannula or a catheter immediately upon removal from the arrangement, without the user having to manually detach the syringe stopper 60 from the Luer 12 first. This reduces the number of manual steps to be performed even further. The wings 81 can be unfolded to provide for a better grip of the syringe 10 during the following administration.

After completed administration the user may re-install the syringe 10 in the syringe holder 30 by attaching the Luer collar 13 to the threaded inner portion 71. The used cannula and/or catheter may be placed in the cap 4, whereafter the cap 4 may be re-mounted on the coupling element 40. Since the piston rod 14 is now fully depressed in the barrel lithe storage space 99 is sufficiently large to accommodate such items. During the re-mounting of the cap 4 on the coupling element 40 the ribs 6 will ride over the ratchet arms 32 as the interior thread 5 is screwed onto the exterior thread 42. Once the cap 4 is repositioned on the coupling element 40 it cannot be removed again because a dismounting movement of the interior thread 5 relative to the exterior thread 42 would cause the ribs 6 to engage the ratchet arms 32 to slave the syringe holder 30 in the direction of rotation of the cap 4. However, as the exterior thread 31 is at the end of the interior thread 41, the syringe holder 30 is not capable of performing any further rotation in that direction, and the cap 4 is thereby locked on the coupling element 40. The mixing device 1 is thus also applicable as a safe, disposable sharps container after completed administration of the mixed product.

Figure 10:
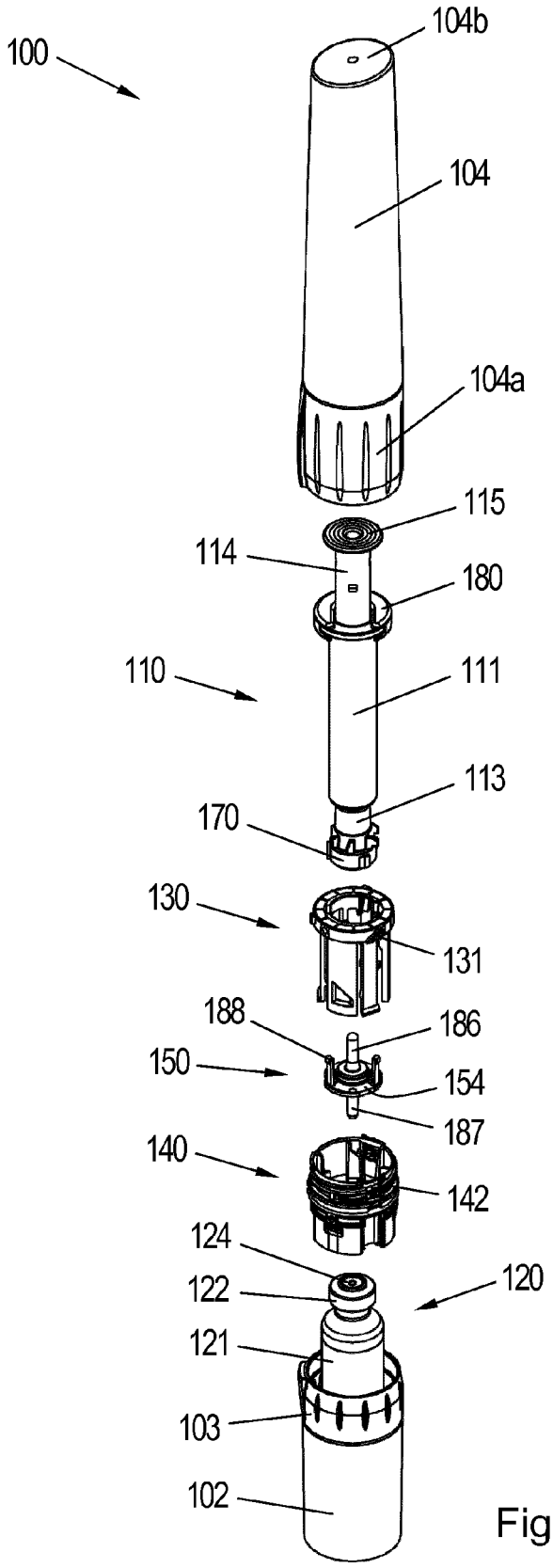
FIG. 10 is an exploded view of a drug mixing arrangement according to another embodiment of the invention.

FIG. 10 is an exploded perspective view of a mixing device 100 for reconstitution of a powdered drug in a vial 120 using a solvent from a syringe 110. The vial 120 comprises a wall 121 having an opening which is sealed by a vial stopper 123 (not visible in this view) and a seal cap 122 having a central opening which exposes a penetrable portion 124 of the vial stopper 123. The vial 120 is arranged in a rigid vial holder 102 which serves to protect the vial 120 from mechanical impacts. A lock ring 103 is translationally and rotationally fixed to the vial holder 102 and is arranged to encircle a distal portion of a coupling element 140 which carries a proximal cap receiving portion in the form of an exterior thread 142.

In the disclosed embodiment the wall 121 is made of glass and the vial holder 102 is made of a transparent plastic. Other suitable materials may, however, be chosen depending on the specific application of the mixing arrangement 100.

The syringe 110 comprises a barrel 111, the outlet of which is surrounded by a threaded Luer collar 113 and sealed by a syringe stopper 160 (not visible in this view). A user manipulable piston rod 114 having a push face 115 for easy operation is adapted to drive a piston 119 (not visible in this view) inside the barrel 111. At its proximal end portion the barrel 111 carries a flange 80 which serves as an enlarged transversal section to offer a more ergonomic grip of the syringe 10 as well as a mechanical stop to prevent the piston rod 114 from being pulled completely out of the barrel 111.

The syringe 110 is supported by a syringe holder 130 to which it is translationally and rotationally releasably fixed via a stopper retainer 170. The syringe holder 130 comprises a track follower 131, designed to travel a suitable helical track, and is configured to accommodate a connector piece 150 comprising a spike base 154 from which a distally pointing hollow spike member 152 (not visible in this view) extends towards the vial 120 and a proximally pointing hollow spike member 153 (not visible in this view) extends towards the syringe 110. The spike member 153 is covered by a penetrable sheath 186 which is sealingly connected to a proximal face of the spike base 154. Likewise, the spike member 152 is covered by a penetrable sheath 187 which is sealingly connected to a distal face of the spike base 154. The spike base 154 further carries a plurality of proximally pointing stabilising fingers 188.

A cap 104 is adapted to cover the syringe 110 during storage and transportation of the mixing device 100 to prevent unintended operation of the piston rod 114 and thereby to ensure that pressure is not prematurely applied to the contents of the syringe 110. The cap 104 has a distal cap end portion **104*a* which holds a distal interior thread section 105 (not visible in this view) adapted for engagement with the exterior thread 142 and a proximal interior thread 141 (not visible in this view) for engagement with the track follower 131. The cap further has a proximal cap end portion 104*b* which is coupled with the piston rod 114** in a manner that will be explained below.

Figure 11:
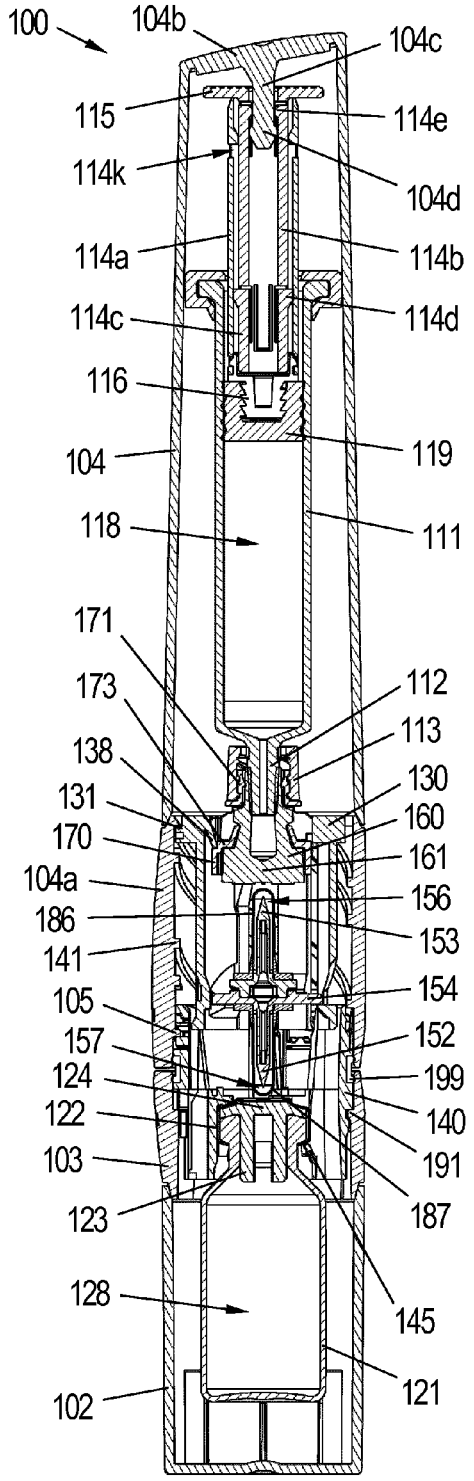
FIG. 11 is a longitudinal section view of the arrangement of FIG. 10, in a pre-use state.

FIG. 11 is a longitudinal section view of the mixing device 100 in the assembled state, prior to a first use thereof, showing further details of the arrangement. This state corresponds to the one in which the mixing device 100 is intended to be delivered by the manufacturer. The piston rod 114 is in a retracted position in the barrel 111, thereby defining a syringe interior 118 capable of holding a volume of a solvent (not shown). The piston rod 114 is coupled firmly to the piston 119 via a jagged coupling head 116.

The piston rod 114 comprises an outer tube **114*a*, which is translationally locked with respect to the coupling head 116, and an inner tube 114*b* which is axially slidable relative to the outer tube 114*a*. The inner tube 114*b* has a couple of radially deflectable distal sections 114*c*, each terminating in a radially outwardly protruding portion 114*d*, forming a hook. In a non-loaded condition of the inner tube 114***b* the radial dimension across the outwardly protruding portions 114*d* is larger than the inner diameter of the outer tube 114*a*. Hence, in the shown pre-use state of the mixing device 100 the outwardly protruding portions 114*d* are biased towards the inner wall of the outer tube 114*a* due to the distal sections 114*c* being elastically inwardly deflected by the contact between the outwardly protruding portions 114*d* and the inner wall of the outer tube 114*a*. The outwardly protruding portions 114*d* are configured to slide along the inner wall of the outer tube 114*a* during extension of the piston rod 114 until they reach respective side apertures 114*k* in the outer tube 114*a*. The side apertures 114*k* are adapted to receive the outwardly protruding portions 114*d* as they are forced thereinto when the distal sections 114*c* relax at the relative axial position of the outer tube 114*a* and the inner tube 114*b* that defines the extended state of the piston rod 114 (see FIG. 12).

A protrusion 104*c* extends distally from the proximal cap end portion 104*b* of the cap 104 and terminates in a radially enlarged knob 104*d* positioned just distally of a pair of radially inwardly protruding end portions 114*e* of the inner tube 114*b*. The radially inwardly protruding end portions 114*e* are arranged on respective radially deflectable fingers 114*h* (see FIG. 14) at the proximal end portion of the inner tube 114*b*.

A Luer 112, defining an outlet of the syringe 110, protrudes into the distal portion of the syringe holder 130 and is retained therein via a screw thread connection between the Luer collar 113 and a threaded portion 171 of a stopper retainer 170. The stopper retainer 170 is translationally and rotationally locked with respect to the syringe holder 130, i.a. via a plurality of circumferentially spaced apart pawls 138, and the syringe stopper 160 is translationally locked with respect to the stopper retainer 170 by a wedge portion 173. This is described in further detail below. A proximal portion of the syringe stopper 160 is sandwiched between the Luer 112 and the threaded portion 171 and thereby provides a fluid tight engagement with the exterior surface of the Luer 112. A distal portion of the syringe stopper 160 has a penetrable section 161 allowing for easy rupturing of the syringe sealing by a suitable tool.

The connector piece 150 is accommodated by the syringe holder 130, as described further below, and is arranged axially between the syringe 110 and the vial 120 such that the spike member 152 is positioned just proximally of, but spaced apart from, the penetrable portion 124 of the vial stopper 123, and the spike member 153 is positioned just distally of, but spaced apart from, the penetrable section 161 of the syringe stopper 160. The syringe 110 and the vial 120 are therefore fluidly unconnected at this point.

The connector piece 150 has been sterilised before assembly of the medical device 100, such that the sheath 186, formed from a material which is permeable to e.g. a sterilisation gas but impermeable to germs, provides a sealed space 156 for the spike member 153 having a high airborne particulate cleanliness, and such that the sheath 187, formed from the same or a like material as the sheath 186, provides a sealed space 157 for the spike member 152 having a similarly high airborne particulate cleanliness, thereby ensuring a sterile flow route through a lumen 155 (see FIG. 12) defined by the two hollow spike members 152, 153 and the spike base 154.

The coupling element 140 has a number of circumferentially spaced apart catch arms 145 extending upwards from a circumferential interior portion and a number of circumferentially spaced apart abutment surfaces 144 (see FIG. 12) for securing translational retainment of the vial 120. The coupling element 140 is itself translationally fixed with respect to the lock ring 103 via a plurality of circumferentially distributed edges 191. A sealing ring 199, e.g. made from a suitable rubber, is arranged between the lock ring 103, the coupling element 140, and the distal cap end portion 104*a* to provide a fluidly sealed internal environment for the syringe 110, the connector piece 150, and the vial 120 in the pre-use state of the mixing device 100. The wall 121 defines a vial interior 128 capable of holding an amount of powdered drug (not shown) to be reconstituted by the solvent from the syringe 110.

Figure 12:
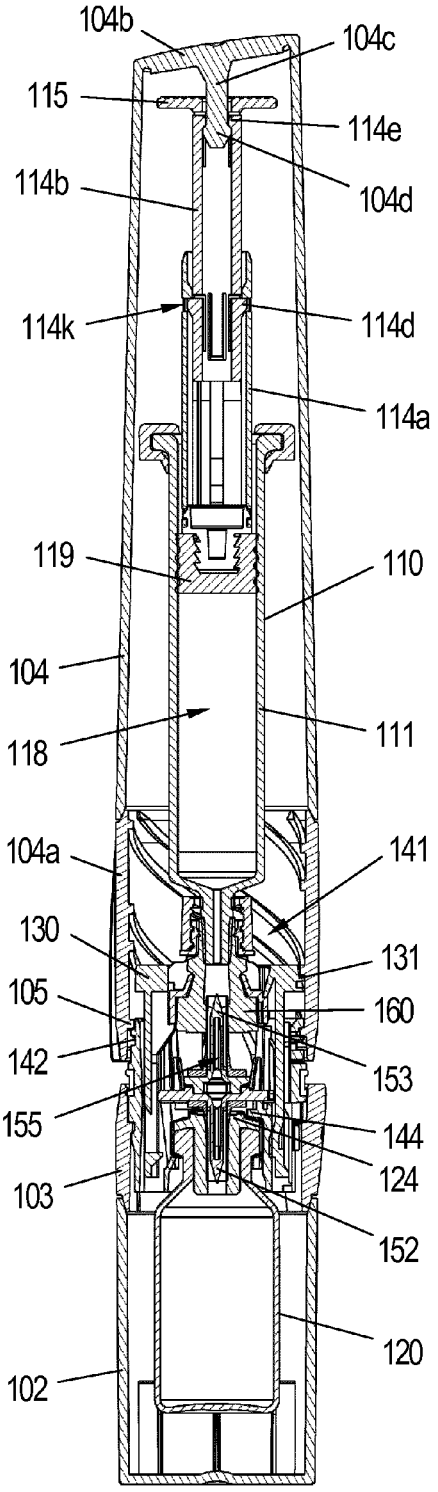
FIG. 12 is a longitudinal section view of the arrangement during establishment of fluid connection between the included reservoirs.

FIG. 12 shows the mixing device 100 during dismounting of the cap 104 from the cap receiving portion of the coupling element 140. The interior thread section 105 is not yet completely disengaged from the exterior thread 142, so the cap 104 is only loosened. During the travel of the interior thread section 105 along the exterior thread 142 the track follower 131 has travelled along the interior thread 141, displacing the syringe holder 130, and thereby the syringe 110, distally towards the vial 120. During the first part of the distal displacement of the syringe holder 130 the spike member 152 has penetrated the sheath 187 and the penetrable portion 124 of the vial stopper 123. Subsequently, the spike member 153 has penetrated the sheath 186 and is, in the shown state of the mixing device 100, transpiercing the penetrable section 161 of the syringe stopper 160, i.e. a fluid connection between the syringe interior 118 and the vial interior 128 is yet only close to being properly established. Further, the distal displacement of the syringe 110 relative to the coupling element 140 and the proximal displacement of the cap 104 relative to the coupling element 140 have caused the knob 104*d* to interface with the inwardly protruding end portions 114*e* and pull the inner tube 114*b* proximally relative to the outer tube 114*a*, whereby the outwardly protruding portions 114*d* has slid axially along the inner wall of the outer tube 114*a* until they have reached the side apertures 114*k*. At this point the deflectable distal sections 114*c* have forced the outwardly protruding portions 114*d* into engagement with the side apertures 114*k* to thereby interlock the outer tube 114*a* and the inner tube 114*b*, securing an extended state of the piston rod 114.

The piston rod 114 is designed such that the friction between the outer tube 114*a* and the inner tube 114*b* is significantly lower than the friction between the piston 119 and the barrel 111, whereby it is ensured that the dismounting of the cap 104 from the cap receiving portion and the induced extension of the piston rod 114 does not affect the position of the piston 119 in the syringe 110.

Further unscrewing of the cap 104 will displace the syringe holder 130 a little further distally to allow the spike member 153 to completely penetrate the syringe stopper 160 and thereby ensure proper establishment of a fluid communication between the syringe interior 118 and the vial interior 128. The last part of the relative axial motion between the syringe 110 and the cap 104 will also cause the knob 104*d* to elastically deflect the fingers 114*h* radially outwards to allow complete disengagement of the protrusion 104*c* from the inner tube 114*b* and thereby of the cap 104 from the syringe 110.

Figure 13:
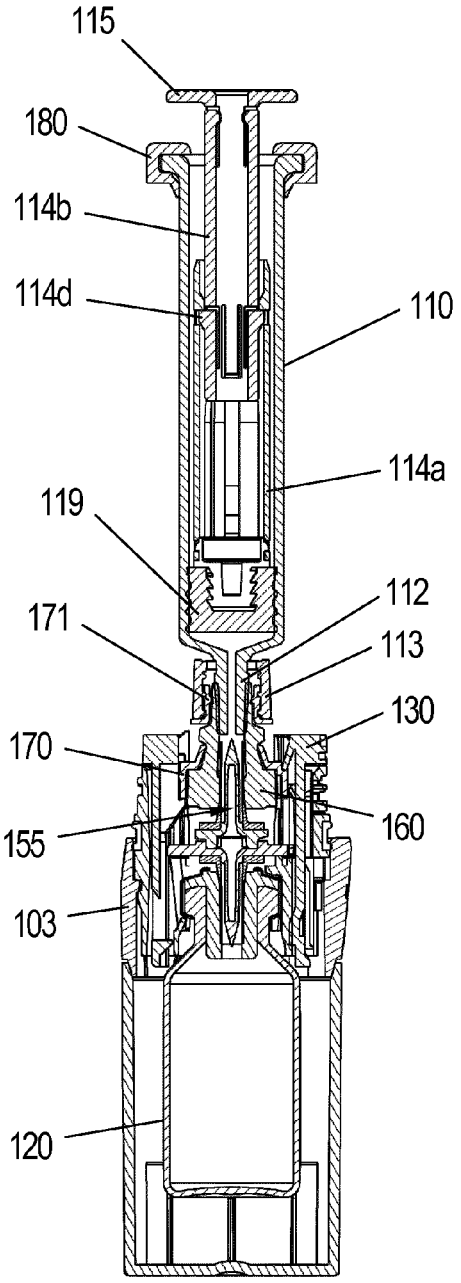
FIG. 13 is a longitudinal section view of the arrangement after establishment of fluid connection and subsequent complete removal of the cover.

FIG. 13 shows the mixing device 100 after removal of the cap 104 and collapse of the syringe interior 118 by depression of the piston rod 114. The solvent originally contained in the syringe 110 has now been transferred to the vial 120 for reconstitution of the powdered drug therein.

Figure 14:
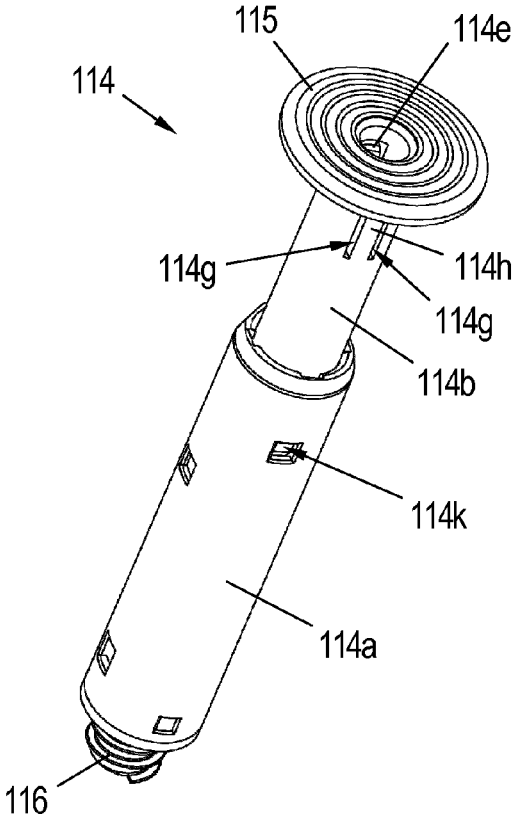
FIG. 14 is a perspective view of the extendable piston rod used in the arrangement.

FIG. 14 is a perspective view of the extendable piston rod 114 between its collapsed and extended states. It is i.a. seen that the deflectable fingers 114*h* are formed in the inner tube 114*b* by the provision of parallel longitudinal slits 114*g*.

Figure 15A:
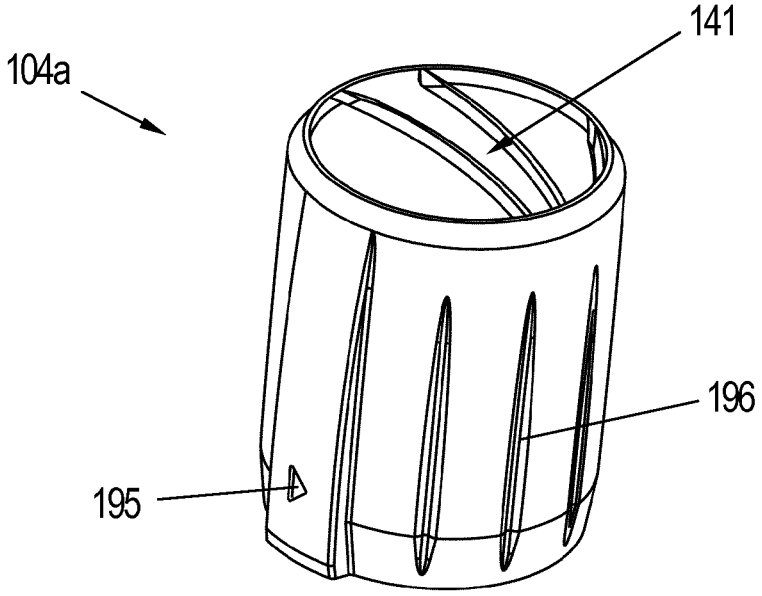
FIGS. 15*a* and 15*b* are perspective proximal, respectively distal views of the distal portion of the cover.

FIG. 15*a* is a perspective proximal view of the distal cap end portion 104*a*, showing the proximal interior thread 141. An arrowhead 195 on the exterior surface informs the user of the dismounting direction of rotation of the cap 104 relative to the lock ring 103. Further, to improve the user's grip on the cap 104 longitudinal grooves 196 are distributed about the circumference of the distal cap end portion 104*a*. Corresponding grooves may be provided on the exterior surface of the lock ring 103.

Figure 15B:
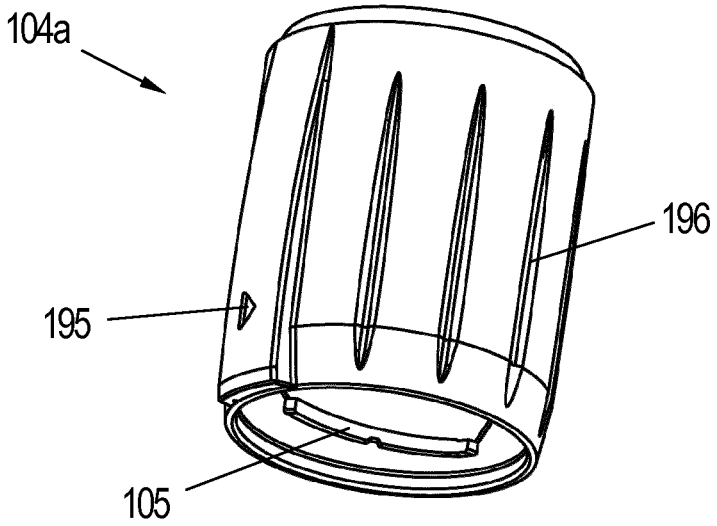

FIG. 15*b* is a perspective distal view of the distal cap end portion 104*a*, showing the distal interior thread section 105. By comparison with FIG. 15*a* it is clear that the pitch of the distal interior thread section 105 is significantly smaller than the pitch of the proximal interior thread 141.

Figure 16A:
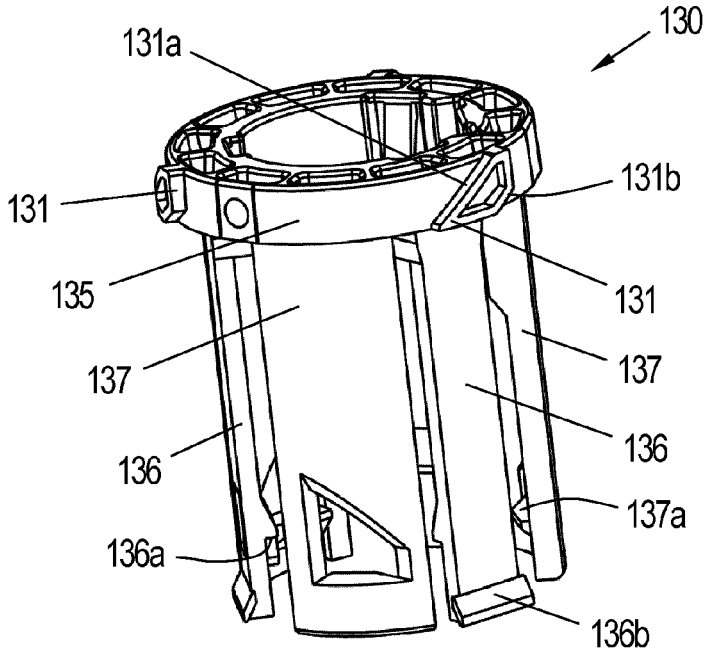
FIGS. 16*a* and 16*b* are different perspective views of the syringe support element.

FIG. 16*a* is a perspective proximal view of the syringe holder 130, detailing its particular configuration. Three track followers 131 are distributed evenly about the circumference of a base ring 135, each track follower 131 comprising an inclined leading face 131*a* and a similarly inclined trailing face 131*b* arranged to fit in the interior thread 141. Six legs extend distally from the distal portion of the base ring 135 and together form a tubular skeletal structure. There are three supporting legs 137 and three guiding legs 136 distributed circumferentially in an alternating fashion. Each supporting leg 137 comprises a support surface 137*a* for interaction with the distal face of the spike base 154, and each guiding leg 136 comprises an abutment surface 136*a* axially spaced apart from the support surfaces 137*a* for interaction with the proximal face of the spike base 154. The axial distance between the support surfaces 137*a* and the abutment surfaces 136*a* correspond to the thickness of the spike base 154, and the support surfaces 137*a* and the abutment surfaces 136*a* thus together function as axial retention means for the connector piece 150. The distal end portion of each guiding leg 136 is provided with a transverse beam structure 136*b* of circumferentially larger dimension than the rest of the guiding leg 136.

Figure 16B:
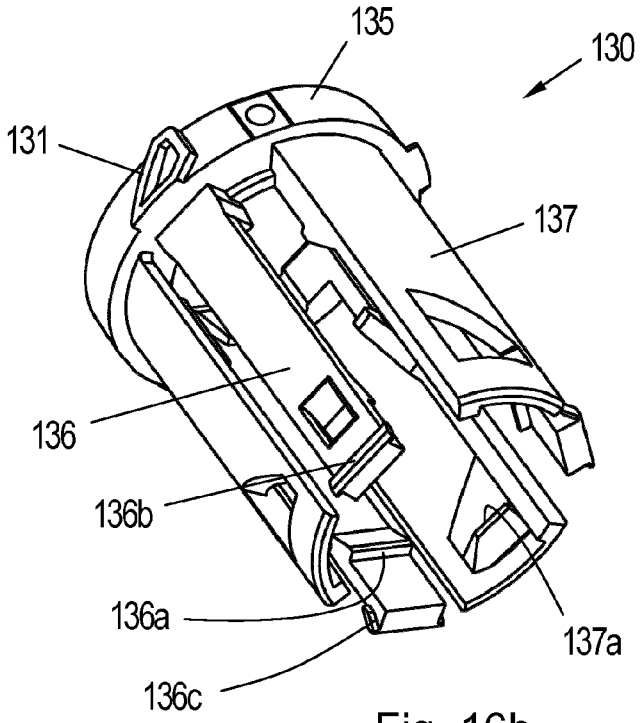

FIG. 16*b* is a perspective distal view of the syringe holder 130. From this figure it is seen that the transverse beam structures 136*b* are arranged to provide circumferential protrusions 136*c* from both sides of the guiding legs 136.

Figure 17A:
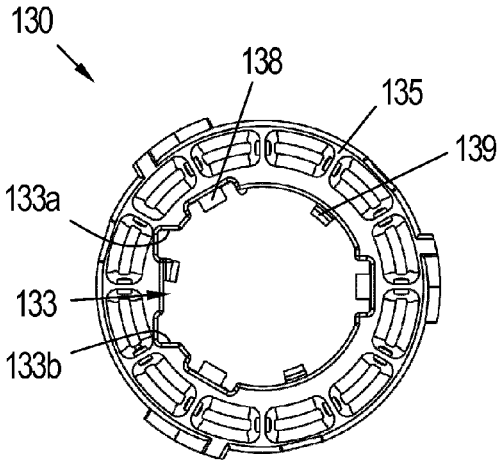
FIG. 17*a* is a top view of the syringe support element.

FIG. 17*a* is a top view of the syringe holder 130, showing a pair of opposed circumferentially spaced apart vertical stop surfaces 133*a*, 133*b* that provide a recess 133 for rotational retention of the stopper retainer 170, three circumferentially evenly distributed distally pointing ratchet arms 138 and three circumferentially evenly distributed proximally pointing ratchet arms 139.

Figure 17B:
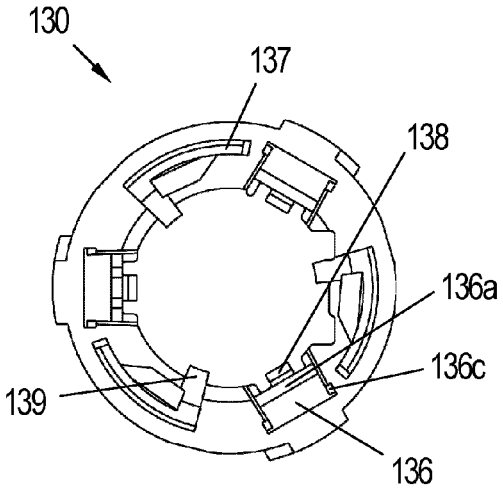
FIG. 17*b* is a bottom view of the syringe support element.

FIG. 17*b* is a bottom view of the syringe holder 130. It shows that the proximally pointing ratchet arms 139 are arranged on the supporting legs 137.

Figure 18:
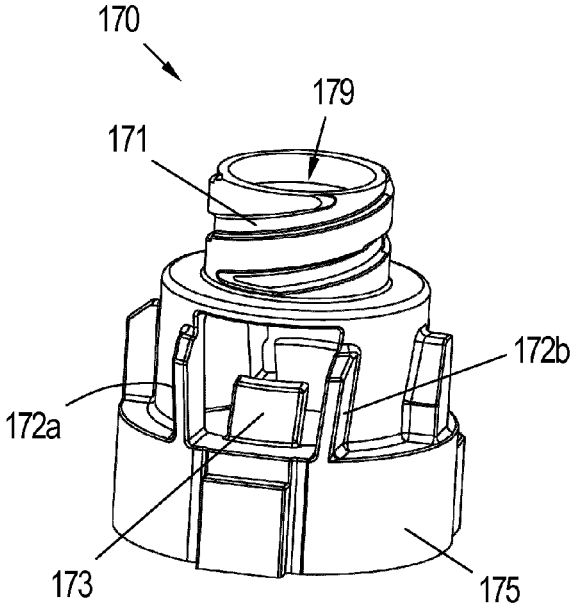
FIG. 18 is a perspective view of the syringe closure retaining element.

FIG. 18 is a perspective view of the stopper retainer 170. It shows the threaded portion 171 arranged on a connecting pipe having a central opening 179 for reception of the syringe stopper 160 and the Luer 112. The stopper retainer 170 further comprises a stepped cylindrical frame 175 carrying the wedge portion 173 and a pair of circumferentially spaced apart vertical walls 172*a*, 172*b* adapted for interaction with the stop surfaces 133*a*, 133*b*.

Figure 19:
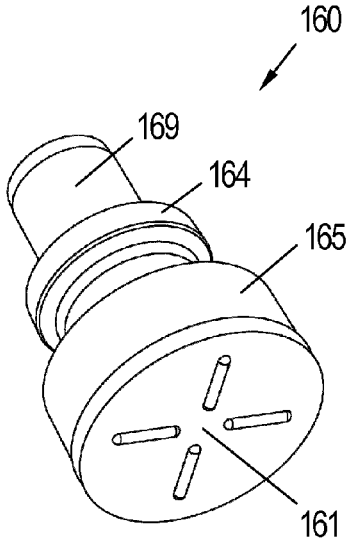
FIG. 19 is a perspective view of the penetrable syringe closure.

FIG. 19 is a perspective view of the syringe stopper 160 which has a proximal tubular section 169 for reception of the Luer 112, a central collar 164 and a distal collar 165. The wall portion connecting the central collar 164 and the distal collar 165 is conical and structured to receive the wedge portion 173 for translational retention of the syringe stopper 160 to the stopper retainer 170.

Figure 20A:
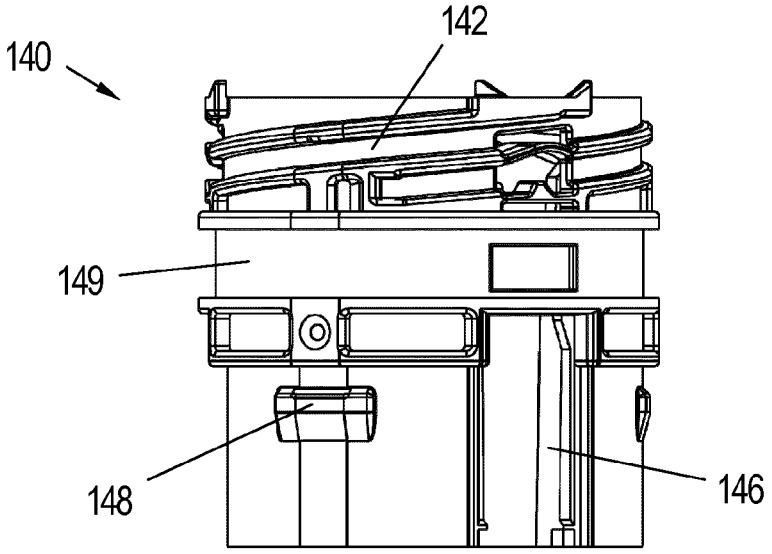
FIGS. 20*a* and 20*b* are, respectively, a side view and a perspective view of the coupling element.

FIG. 20*a* is a side view of the coupling element 140, showing a plurality of circumferentially distributed lugs 148 for engagement with the edges 191 for translational fixation of the lock ring 103 to the coupling element 140. A circumferential narrowing 149 is provided for reception of the sealing ring 199. A plurality of guide structures 146 are provided for interaction with the guiding legs 136 during a relative axial motion between the coupling element 140 and the syringe holder 130, as will be explained in further detail below.

Figure 20B:
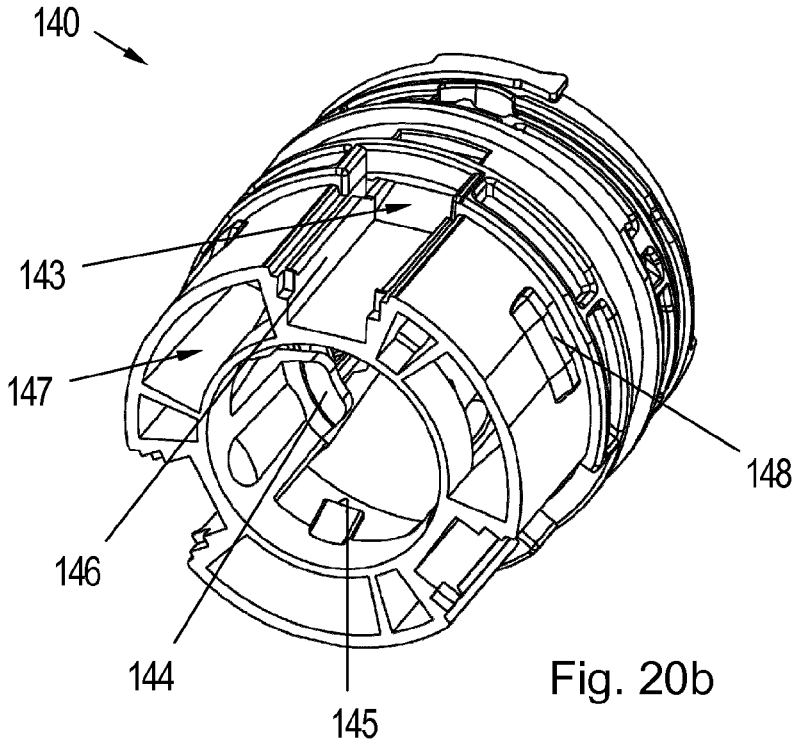

FIG. 20*b* is a perspective distal view of the coupling element 140 and shows three circumferentially spaced apart longitudinal channels 143, each channel 143 being adapted to allow passage of one of the guiding legs 136 during relative axial motion between the coupling element 140 and the syringe holder 130, and three longitudinal passages 147, each passage 147 being adapted to allow passage of one of the supporting legs 137 during relative axial motion between the coupling element 140 and the syringe holder 130. During the passage of the guiding legs 136 through the longitudinal channels 143 each circumferential protrusion 136*c* slides along at least a portion of a guide structure 146. The longitudinal channels 143 and the longitudinal passages 147 provide for a splined relationship between the coupling element 140 and the syringe holder 130, i.e. allowing only non-rotational relative motion therebetween.

Figure 21:
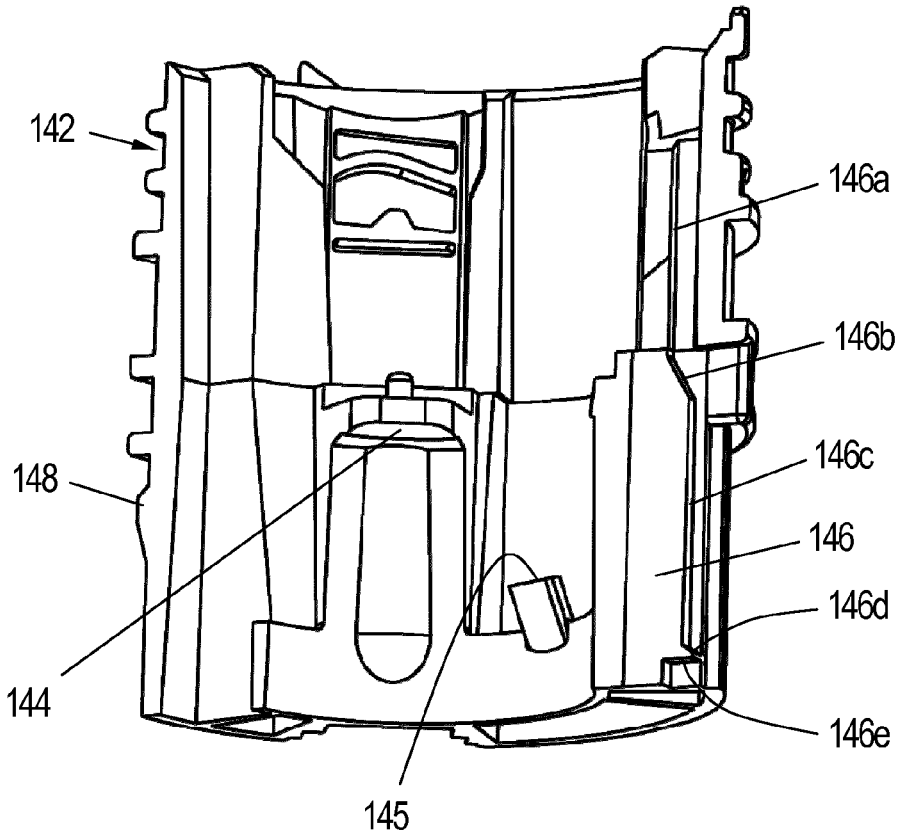
FIG. 21 is a perspective sectional view of a portion of the coupling element detailing the various guide surfaces used in the interaction with the syringe support element.

FIG. 21 is a perspective cross-sectional view of the coupling element 140, detailing the configuration of the guide structures 146. Each guide structure 146 comprises a proximal straight, vertical (or substantially vertical) guide surface 146*a*, and a distal straight, vertical (or substantially vertical) guide surface 146*c*, that are bridged by an inclined guide surface 146*b*. Further, at the distal end portion of the distal guide surface 146*c* a ramp 146*d* is provided which connects the distal guide surface 146*c* with a stop surface 146*e*.

Operation of the Mixing Device Represented by FIGS. 10-21

In the following a situation of use of the mixing device 100 will be described. The user actions required to fluidly connect the syringe 110 and the vial 120, reconstitute the powdered drug, and remove the syringe 110 from the syringe holder 130 are identical to what is described above in connection with the mixing device 1. However, the response of the mixing device 100 to at least some of the user actions is different from that of the mixing device 1, as will be clear from the below.

In order to gain access to the piston rod 114 and transfer the solvent from the syringe interior 118 to the vial interior 128 a subject user firstly grips the mixing device 100 by the lock ring 103 and holds the lock ring 103 between two or more fingers of one hand, preferably with the syringe 110 pointing upwards. She or he then grips the cap 104 with the other hand and makes a turning motion in the direction of the arrowhead 195 to unscrew the interior thread 105 from the exterior thread 142. The cap 104 will be released from the coupling element 140 upon half a revolution.

During the dismounting motion of the cap 104 relative to the cap receiving portion (constituted by the exterior thread 142) the track followers 131 travel along the interior thread 141, and the syringe holder 130, being splined to the coupling element 140 via the interaction between the guiding legs 136, respectively the supporting legs 137, and the channels 143, respectively the passages 147, is forced non-rotationally downwards towards the vial 120. Because the syringe 110 is translationally locked with respect to the stopper retainer 170, due to the connection between the Luer collar 113 and the threaded portion 171, and the stopper retainer 170 is translationally locked with respect to the syringe holder 130, due to the fixation of the distal end portion of the stepped cylindrical frame 175 between the ratchet arms 138, 139, the syringe 110 is displaced downwards along with the syringe holder 130.

The downward movement of the syringe holder 130 causes a downward movement of the connector piece 150 due to the fixation of the spike base 154 between the abutment surfaces 136*a* and the support surfaces 137*a*. The distally directed force on the proximal face of the spike base 154 applied by the abutment surfaces 136*a* will cause the spike member 152 to encounter the vial stopper 123, penetrate the sheath 187 and the penetrable portion 124 and enter into the vial interior 128. As this happens, the circumferential protrusions 136*c* travel along the vertical guide surfaces 146*a*. Following complete penetration of the penetrable portion 124 the further downward movement of the syringe holder 130 causes the circumferential protrusions 136*c* to reach and travel the inclined guide surfaces 146*b*, whereby the guiding legs 136 are forced to deflect radially outwards, freeing the proximal face of the spike base 154 from the abutment surfaces 136*a*. During the subsequent downward movement of the syringe holder 130 the connector piece 150 therefore undergoes relative axial motion with respect to the guiding legs 136, whereby the spike member 153 is eventually brought into contact with the syringe stopper 160 and caused to penetrate the sheath 186 and the penetrable section 161. As this happens, the circumferential protrusions 136*c* travel along the vertical guide surfaces 146*c*.

Following complete penetration of the penetrable section 161 and thereby establishment of a fluid communication between the syringe interior 118 and the vial interior 128 a small final downward movement of the syringe holder 130 causes the circumferential protrusions 136*c* to pass over the ramps 146*d* and snap behind them, whereupon the stop surfaces 146*e* act to prevent any return movement of the guiding legs 136 in the channels 143, effectively locking the syringe holder 130 axially to the coupling element 140.

Simultaneously with, or subsequent to, the locking of the syringe holder 130 to the coupling element 140 the interior thread 105 disengages from the exterior thread 142, and the cap 104 is dismounted from the cap receiving portion. However, the downward displacement of the syringe holder 130 not only causes the syringe 110 and the vial 120 to fluidly connect, it also extends the piston rod 114 from the collapsed state shown in FIG. 11 to the extended state shown in FIG. 12. As the stopper retainer 170 is forced downwards by the engagement with the syringe holder 130, so is the syringe 110 containing the piston 119. Because the outer tube 114*a* is translationally locked to the piston 119 via the coupling head 116 and the inner tube 114*b* is coupled with the cap 104 via the knob 104*d* the outer tube 114*a* is forced to move downwards a distance corresponding to the movement of the syringe holder 130, while the inner tube 114*b* is forced to move upwards a distance corresponding to (or nearly corresponding to depending on whether an initial clearance is provided between the knob 104*d* and the end portions 114*e*) the axial movement of the cap 104 relative to the coupling element 140. This relative axial motion between the outer tube 114*a* and the inner tube 114*b* causes the outwardly protruding portions 114*d* to slide along the inner wall of the outer tube 114*a* until they reach and snap into the side apertures 114*k*. At this point the outer tube 114*a* and the inner tube 114*b* are translationally locked to one another, and the user will perceive the piston rod 114 as if it consisted of a single cylindrical piece. Further dismounting motion of the cap 104 relative to the cap receiving portion causes the knob 104*d* to deflect the fingers 114*h* radially outwards and pass the end portions 114*e*, whereby the cap 104 disconnects from the piston rod 114.

The cap 104 is now both disengaged from the exterior thread 142 and the piston rod 114, and it can thus be removed to expose the syringe 110 for operation. At this point the user holds the mixing device 100 such that the syringe 110 faces upwards. By depression of the piston rod 114 the piston 119 is advanced in the barrel 111 to force the solvent out through the Luer 112, further through the lumen 155 and into the vial 120, where it mixes with the powdered drug. The mixing device 100 is then turned up-side down and the piston rod 114 is gradually released to allow the built up pressure in the vial 120 to cause or assist a transfer of the mixed product out of the vial 120, through the lumen 155 and into the syringe 110. Alternatively, or additionally, the piston rod 114 is pulled backwards in the barrel 111 to cause or assist the transfer of the mixed product from the vial 120.

Once the mixed product is fully contained within the syringe 110, the syringe 110 is removed from the rest of the arrangement. This may be done e.g. by gripping the lock ring 103 with one hand and the Luer collar 113 with a couple of fingers of the other hand and then rotating the Luer collar 113 relative to the syringe holder 130. Because the stopper retainer 170 is rotationally locked with respect to the syringe holder 130, due to the interaction between the respective vertical walls 172*a*, 172*b* and stop surfaces 133*a*, 133*b*, the Luer collar 113 is easily unscrewed from the threaded portion 171. Further, since the syringe stopper 160 is translationally fixed to the stopper retainer 170, due to the interface of the wedge portion 173 with the central collar 164 and the distal collar 165, when the Luer collar 113 disengages from the threaded portion 171 the syringe stopper 160 remains in the stopper retainer 170, leaving the Luer 112 exposed. Thus, the syringe 110, containing the administrable drug, is ready for connection with e.g. a cannula or a catheter immediately upon removal from the syringe holder 130, without the user having to manually detach the syringe stopper 160 from the Luer 112 first, and the rest of the mixing device 100 can be discarded.

The invention claimed is:

1. A medical arrangement comprising:

a first container comprising a variable volume chamber holding a first medium, a second container holding a second medium, a fluid connection structure for establishing a fluid connection between the first container and the second container, a cover receiving portion, and a cover removably mounted on the cover receiving portion to shield at least an operable portion of the first container, wherein the cover is operatively coupled with the fluid connection structure and configured to cause a relative converging motion between at least one of a) the first container and the fluid connection structure and b) the second container and the fluid connection structure in response to a dismounting of the cover from the cover receiving portion.

2. A medical arrangement according to claim 1, wherein the fluid connection structure establishes fluid connection between the first container and the second container in response to the dismounting of the cover from the cover receiving portion.

3. A medical arrangement according to claim 1, wherein the cover forms part of an enclosure for the first container, the second container, and the fluid connection structure.

4. A medical arrangement according to claim 1, wherein the first container defines a general axis, and wherein the first container, the second container, and the fluid connection structure are arranged co-axially along the general axis.

5. A medical arrangement according to claim 1, wherein the volume of the variable volume chamber is varied by operation of an actuator, and wherein the cover is adapted to shield at least a user operable portion of the actuator when mounted on the cover receiving portion.

6. A medical arrangement according to claim 1, further comprising a first container support element for holding the first container, wherein the cover and the cover receiving portion are adapted for threaded engagement via a first track section having a first pitch, and wherein the dismounting of the cover from the cover receiving portion causes a relative helical motion between the first container support element and the cover, said relative helical motion being defined by a second track section having a second pitch which is greater than the first pitch.

7. A medical arrangement according to claim 6, further comprising a guide interface structured to provide for a guided relative motion between the first container support element and the second container during the dismounting of the cover from the cover receiving portion, wherein the cover is structured to interact with the first container support element to activate the first container support element in response to a dismounting motion of the cover relative to the cover receiving portion, and wherein the guide interface is structured to displace an activated first container support element non-rotationally towards the second container.

8. A medical arrangement according to claim 7, wherein the cover receiving portion is arranged on a coupling element, and wherein the coupling element and the second container are substantially translationally locked with respect to one another.

9. A medical arrangement according to claim 8, wherein the fluid connection structure comprises a base section having a first face and an opposite second face, a first penetration member protruding axially from the first face for penetrating a first container closure, a second penetration member protruding axially from the second face for penetrating a second container closure, and a lumen extending through the first penetration member, the base section, and the second penetration member, and wherein the first container support element comprises first positioning structure interacting with the first face and second positioning structure interacting with the second face to translationally fix the fluid connection means relative to the first container at a position in which the first penetration member is spaced apart from the first container closure, the first positioning structure being configured to automatically abort the interaction with the first face upon penetration of the second container closure by the second penetration member, thereby enabling relative translational motion between the fluid connection structure and the first container.

10. A medical arrangement according to claim 9, wherein the first positioning structure comprises a plurality of radially deflectable legs extending axially from a circumferential base of the first container support element, each leg comprising an inwardly extending abutment surface for abutment with a portion of the first face, and wherein the coupling element comprises a plurality of sloping guide surfaces configured to guide the plurality of radially deflectable legs outwards upon penetration of the second container closure by the second penetration member during the relative motion between the first container support element and the second container, whereby the abutment surfaces are brought out of contact with the first face.

11. A medical arrangement according to claim 10, wherein the coupling element further comprises locking structure for interacting with the first container support element to translationally lock the first container support element with respect to the second container upon subsequent penetration of the first container closure by the first penetration member.

12. A medical arrangement according to claim 11, wherein each of the plurality of radially deflectable legs further comprises a catch portion, and wherein the coupling element further comprises a plurality of ramp portions, each ramp portion being structured to deflect one of the radially deflectable legs radially outwards during the relative motion between the first container support element and the second container and to allow the radially deflectable leg to elastically recover beyond a ramp edge such that the catch portion interfaces with a distal side of the ramp portion.

13. A medical arrangement according to claim 1, further comprising a first container support element for supporting the first container, and a guide structure adapted to guide a relative motion between the first container support element and the second container during the dismounting of the cover from the cover receiving portion, wherein the guide structure comprises a first thread on the cover receiving portion and a mating first container support thread on the first container support element, and wherein the cover receiving portion comprises a second thread adapted for engagement with a cover thread on the cover, the first thread being a left-hand thread and the second thread being a right-hand thread, or vice versa.

14. An arrangement according to claim 13, wherein the pitch of the first thread is greater than the pitch of the second thread.

15. An arrangement according to claim 13, wherein the cover comprises cover engagement structure adapted to interact with container engagement structure associated with the first container to ensure joint rotational motion of the cover and the first container during dismounting of the cover from the second thread.

16. An arrangement according to claim 15, wherein the cover engagement structure and the container engagement structure are adapted to enable relative rotational motion between the cover and the first container during re-mounting of the cover on the second thread, and wherein the guide structure is configured to lead the first container support thread to the end of the first thread during establishment of fluid connection between the first container and the second container, whereby the cover is capable of being re-mounted on the cover receiving portion only once after fluid connection has been established between the first container and the second container.

17. An arrangement according to claim 13, wherein the first container is a syringe type applicator being removably mounted in the first container support element and comprising a cylindrical barrel and a piston defining a syringe compartment for holding the first medium, the piston being capable of sliding motion with respect to the barrel by operation of a piston rod to selectively decrease and increase the volume of the syringe compartment to transfer the first medium from the first container to the second container through an established fluid connection, to transfer a combination of the first medium and the second medium back to the first container, and to deliver the combination of the first medium and the second medium from the first container upon removal of the first container from the first container support element.

18. An arrangement according to claim 17, wherein the cover is adapted to shield at least a proximal portion of the first container, wherein the first container is adapted for re-mounting in the first container support element, and wherein the piston rod projects less from the barrel when the syringe compartment is collapsed than when the syringe compartment holds the first medium, thereby providing a storage space between the cover and a re-mounted first container after delivery of the combination of the first medium and the second medium.

19. An arrangement according to claim 13, further comprising a base element surrounding at least a portion of the cover receiving portion, the cover receiving portion being capable of rotation relative to the base element, and a second container support for supporting the second container, the second container support being arranged non-rotatably relative to the base element and comprising a thread adapted for engagement with a third thread on the cover receiving portion, wherein the third thread is structured to cause the second container support to move axially towards the fluid connection structure in response to a rotation of the cover receiving portion relative to the base element.

20. An arrangement according to claim 19, wherein the second thread is longer than the first thread, and wherein the cover receiving portion is adapted to rotate relative to the base element in response to a dismounting rotation of the cover, when the first container support thread has travelled to the end of the first thread.

21. An arrangement according to claim 19, wherein the second container support comprises an at least partially enclosing frame accommodating the second container, the frame comprising bias structure for biasing the second container towards the first container.

22. An arrangement according to claim 13, wherein the first container support thread comprises a first catch geometry and the cover receiving portion comprises a second catch geometry adapted to engage with the first catch geometry during coupling of the first container support thread and the first thread at a predefined axial position of the first container support element relative to the cover receiving portion.

23. A medical arrangement according to claim 6, wherein the first container is releasably coupled with the first container support element, and wherein the first container comprises an outlet sealed by a penetrable first container closure which is non-releasably coupled with the first container support element.

24. A medical arrangement according to claim 1, wherein the cover is a rigid cap.

25. An assembly comprising:

a first container comprising a variable volume chamber holding a first medium, a reception structure adapted to receive and retain a second container holding a second medium, a fluid connection structure for establishing fluid connection between the first container and the second container, when the second container is retained by the reception structure, a cover receiving portion, and a cover removably mounted on the cover receiving portion to shield at least a portion of the first container, wherein the cover is operatively coupled with the fluid connection structure and configured to cause a relative converging motion between at least one of a) the first container and the fluid connection structure and b) the reception structure and the fluid connection structure in response to a dismounting of the cover from the cover receiving portion.

* * * * *